US009406272B2

(12) United States Patent
Lee et al.

(10) Patent No.: US 9,406,272 B2
(45) Date of Patent: Aug. 2, 2016

(54) GATE DRIVING CIRCUIT HAVING FORWARD AND REVERSE SCAN DIRECTIONS AND DISPLAY APPARATUS IMPLEMENTING THE GATE DRIVING CIRCUIT

(75) Inventors: Jae-Hoon Lee, Seoul (KR); Bon-Yong Koo, Chungcheongnam-do (KR); Seung-Hwan Moon, Chungcheongnam-do (KR); Won-Hee Lee, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 298 days.

(21) Appl. No.: 13/301,637

(22) Filed: Nov. 21, 2011

(65) Prior Publication Data

US 2012/0293467 A1 Nov. 22, 2012

(30) Foreign Application Priority Data

May 18, 2011 (KR) ..... 10-2011-0046737

(51) Int. Cl.
*G09G 3/36* (2006.01)

(52) U.S. Cl.
CPC ..... *G09G 3/3677* (2013.01); *G09G 2300/0408* (2013.01); *G09G 2300/0426* (2013.01); *G09G 2310/0283* (2013.01)

(58) Field of Classification Search
USPC ..... 345/55, 98–100; 326/62, 63, 80; 327/333
See application file for complete search history.

(56) References Cited

U.S. PATENT DOCUMENTS

| | | | | |
|---|---|---|---|---|
| 7,831,010 | B2 | 11/2010 | Tobita | |
| 8,754,674 | B2 | 6/2014 | Lee et al. | |
| 8,860,648 | B2 | 10/2014 | Lee et al. | |
| 2007/0248204 | A1* | 10/2007 | Tobita | 377/64 |
| 2008/0055225 | A1* | 3/2008 | Pak et al. | 345/96 |
| 2010/0277206 | A1 | 11/2010 | Lee et al. | |
| 2011/0018846 | A1* | 1/2011 | Hu et al. | 345/204 |
| 2011/0069044 | A1* | 3/2011 | Lee et al. | 345/204 |
| 2011/0122117 | A1 | 5/2011 | Lee et al. | |

FOREIGN PATENT DOCUMENTS

| | | |
|---|---|---|
| CN | 101064194 | 10/2007 |
| CN | 101877202 A | 11/2010 |
| JP | 2006-201296 | 8/2006 |

(Continued)

OTHER PUBLICATIONS

European Search Report dated Jul. 25, 2012 for European Patent Application No. 11192752.1-2205.

(Continued)

*Primary Examiner* — Ram Mistry
(74) *Attorney, Agent, or Firm* — F. Chau & Associates, LLC

(57) ABSTRACT

A gate driving circuit includes a shift register and a vertical start line. The shift register includes first to N-th circuit stages sequentially providing first to N-th gate-on signals to first to N-th gate lines, respectively, at least one reverse dummy stage adjacent to the first circuit stage and at least one forward dummy stage adjacent to the N-th circuit stage (N is a natural number). The vertical start line is electrically connected to the first circuit stage or the N-th circuit stage according to a scan direction and transfers a vertical start signal to the first or N-th circuit stage.

8 Claims, 14 Drawing Sheets

(56) References Cited

FOREIGN PATENT DOCUMENTS

| | | | | |
|---|---|---|---|---|
| JP | 2009140608 | | | 6/2009 |
| JP | 201086640 | A | | 4/2010 |
| JP | 2010086640 | | | 4/2010 |
| JP | 2010262296 | | | 11/2010 |
| JP | 2011-033961 | | | 2/2011 |
| JP | 2011034047 | | | 2/2011 |
| JP | 2011034047 | A | * | 2/2011 |
| JP | 2011065740 | | | 3/2011 |
| KR | 1020070042242 | | | 4/2007 |
| KR | 1020080058570 | | | 6/2008 |
| KR | 1020090109257 | | | 10/2009 |

OTHER PUBLICATIONS

European Search Report dated Apr. 2, 2012 for European Application No. EP11192752.

Japanese Office Action Dated Dec. 8, 2015.

1 Chinese Office Action Dated Sep. 6, 2015.

* cited by examiner

GATE DRIVING CIRCUIT HAVING FORWARD AND REVERSE SCAN DIRECTIONS AND DISPLAY APPARATUS IMPLEMENTING THE GATE DRIVING CIRCUIT

PRIORITY STATEMENT

This application claims priority under 35 U.S.C. §119 to Korean Patent Application No. 2011-46737, filed on May 18, 2011 in the Korean Intellectual Property Office, the contents of which are herein incorporated by reference in their entireties.

BACKGROUND

1. Technical Field

Exemplary embodiments of the present invention relate to a display panel and a display apparatus having the display panel. More particularly, exemplary embodiments of the present invention relate to a display panel having a gate driving circuit that can simply implement a forward or reverse direction scan mode and a display apparatus having the display panel.

2. Discussion of the Related Art

To decrease a size of a liquid crystal display (LCD) apparatus and to enhance productivity of the LCD apparatus, an amorphous silicon gate (ASG) technology is used in which a gate driving circuit is integrated on a display panel. The gate driving circuit is directly formed on the display panel and sequentially outputs a plurality of gate signals to the display panel.

For example, when a printed circuit board (PCB) is mounted on an upper long side of the display panel, a data driving circuit sequentially outputs data signals in a forward direction from the upper long side of the display panel toward a lower long side of the display panel, and the gate driving circuit sequentially generates a plurality of gate signals to the display panel in the forward direction in synchronization with the data signals, which is referred to as a "forward direction scan mode".

When the printed circuit board (PCB) is mounted on the lower long side of the display panel, the data driving circuit sequentially outputs data signals in a reverse direction from the lower long side of the display panel toward the upper long side of the display panel, and the gate driving circuit generates the gate signals to the display panel in the reverse direction in synchronization with the data signals, which is also referred to as a "reverse direction scan mode.

As such, according to a position of the PCB on the display panel, the gate driving circuit is driven in the forward direction scan mode or reverse direction scan mode. The gate driving circuit may have a scan control signal which controls an advancing direction of the gate signals generated from the gate driving circuit.

As a consequence, different timing control parts for controlling the gate driving circuit are used according to the scan mode, thus resulting in an increase in costs. In addition, the number of control signals controlling the gate driving circuit may be increased and as a consequence, the number of signal lines may be increased. Therefore, an area in which the gate driving circuit is formed may be increased, thus deteriorating appearance of the display apparatus.

SUMMARY

Exemplary embodiments of the present invention provide a simple structure of a gate driving circuit that can be driven in a forward direction scan mode or a reverse direction scan mode and a display apparatus having the gate driving circuit.

According to an embodiment of the present invention, a gate driving circuit includes a shift register and a vertical start line. The shift register includes first to N-th circuit stages sequentially providing first to N-th gate-on signals to first to N-th gate lines, respectively, at least one reverse dummy stage adjacent to the first circuit stage and at least one forward dummy stage adjacent to the N-th circuit stage. The vertical start line is electrically connected to the first circuit stage or the N-th circuit stage according to a scan direction and transfers a vertical start signal controlling a start timing of the shift register to the first or N-th circuit stage.

According to an exemplary embodiment, the gate driving circuit further comprises a clock line transferring a clock signal to at least one of the first to N-th circuit stages.

According to an exemplary embodiment, when the scan direction is a forward direction, the clock line is electrically floated with respect to the reverse dummy stage, and when the scan direction is a reverse direction, the clock line is electrically floated with respect to the forward dummy stage.

According to an exemplary embodiment, the shift register includes an n-th circuit stage (n is a natural number) outputting an n-th gate-on signal, the n-th circuit stage comprises a pull-up control part applying a carry signal of one of previous circuit stages to a control node in response to the carry signal of one of the previous circuit stages which is received before the n-th gate-on signal is outputted according to the scan direction, a pull-up part outputting a clock signal as the n-th gate-on signal in response to a signal applied to the control node, a carry part outputting the clock signal as an n-th carry signal in response to the signal applied to the control node, a first pull-down part pulling down the signal applied to the control node to a first off signal in response to a carry signal of a first next circuit stage which is received after the n-th gate-on signal is outputted, and a second pull-down part pulling down the n-th gate-on signal into the first off signal in response to the carry signal of the first next circuit stage.

According to an exemplary embodiment, when the scan direction is the forward direction, the pull-up control part of the first circuit stage is electrically connected to the vertical start line, and the pull-up control part of the N-th circuit stage is electrically floated with respect to the vertical start line.

According to an exemplary embodiment, when the scan direction is the reverse direction, the pull-up control part of the N-th circuit stage is electrically connected to the vertical start line, and the pull-up control part of the first circuit stage is electrically floated with respect to the vertical start line.

According to an exemplary embodiment, the n-th circuit stage further comprises a reset part pulling down the signal applied to the control node to a second off signal in response to a carry signal of a second next circuit stage.

According to an exemplary embodiment, the gate driving circuit further comprises a falling circuit including first to N-th falling stages which sequentially drop the first to the N-th gate-on signals applied to the first to N-th gate lines to the first off signal, and an auxiliary off line connected to the first to N-th falling stages, wherein the first off signal is transferred to the auxiliary off line.

According to an embodiment of the present invention, a display apparatus includes a display panel, a data driving circuit, a shift register and a vertical start line. The display panel includes a display area and a peripheral area surrounding the display area, and includes first to N-th gate lines sequentially arranged in a forward direction in the display area (N is a natural number). The data driving circuit sequentially provides data signals to the display panel in the forward direction. The shift register is disposed in the peripheral area, and includes first to N-th circuit stages generating first to N-th gate-on signals, respectively, at least one reverse dummy stage adjacent to the first circuit stage and at least one forward dummy stage adjacent to the N-th circuit stage. The vertical start line is electrically connected to the first circuit stage and is electrically floated with respect to the N-th circuit stage. The vertical start line transfers a vertical start signal controlling a start timing of the shift register to the first circuit stage.

According to an embodiment of the present invention, a display apparatus includes a display panel, a data driving circuit, a shift register and a vertical start line. The display panel includes a display area and a peripheral area surrounding the display area, and includes first to N-th gate lines sequentially arranged in a forward direction on the display area (N is a natural number). The data driving circuit sequentially provides data signals to the display panel in a reverse direction opposite to the forward direction. The shift register is disposed in the peripheral area, and includes first to N-th circuit stages respectively generating first to N-th gate-on signals, at least one reverse dummy stage adjacent to the first circuit stage and at least one forward dummy stage adjacent to the N-th circuit stage. The vertical start line is electrically connected to the N-th circuit stage and is electrically floated with respect to the first circuit stage. The vertical start line transfers a vertical start signal controlling a start timing of the shift register.

According to an embodiment of the present invention, there is provided a gate driving circuit comprising a shift register, the shift register including a plurality of first to N-th circuit stages sequentially connected to each other, wherein an n-th circuit stage of the plurality of circuit stages comprises a clock terminal connected to a clock line, a first input terminal connected to a vertical start line when n is 1 or N and connected to a carry terminal of a previous circuit stage when n is neither 1 nor N, a second input terminal connected to a carry terminal of a subsequent circuit stage, a third input terminal connected to a carry terminal of a next circuit stage of the subsequent circuit stage, an output terminal outputting a gate-on signal, and a carry terminal outputting a carry signal.

According to the embodiments of the present invention, only the first metal pattern of the shift register is changed so that the shift register may use the same or substantially the same driving signal for the forward and reverse direction scan modes. An additional driving signal determining the scan mode is unnecessary so that the number of signal lines may be decreased. Therefore, an area in which the gate driving circuit is formed may be decreased so that a bezel of the display apparatus may be reduced.

BRIEF DESCRIPTION OF THE DRAWINGS

The embodiments of the present invention will become more apparent by the following detailed description with reference to the accompanying drawings, in which.

DETAILED DESCRIPTION OF THE INVENTION

Hereinafter, embodiments of the present invention will be described in detail with reference to the accompanying drawings.

Figure 1:
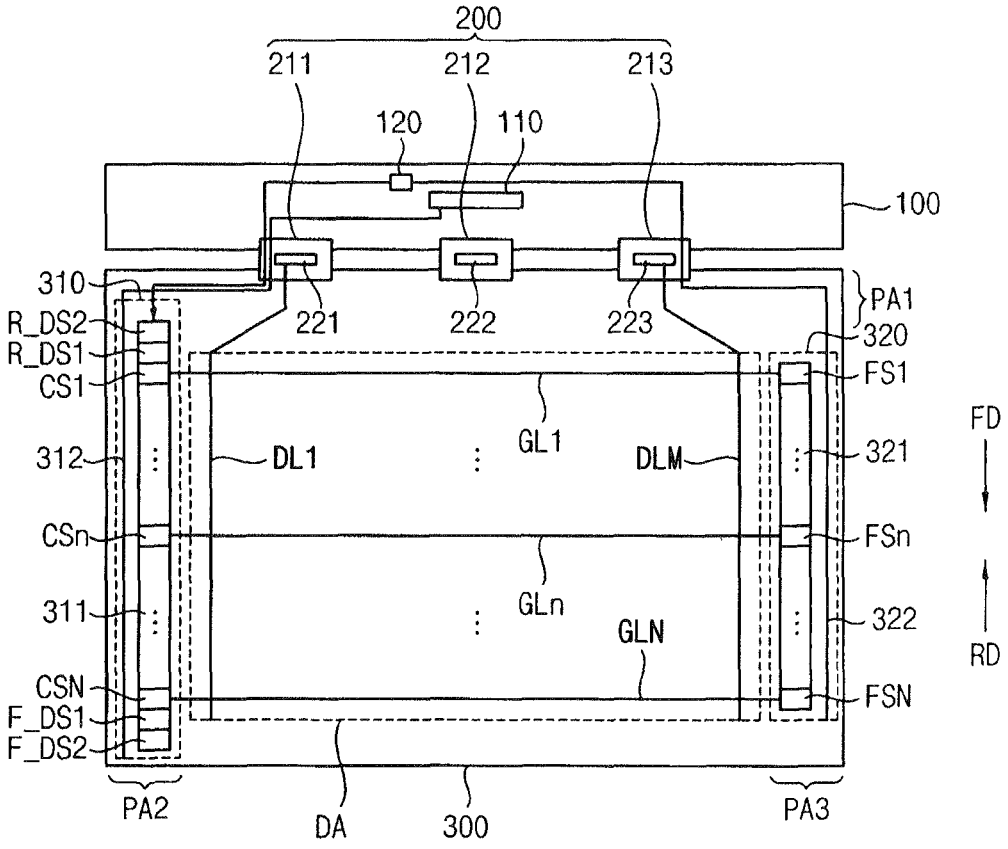
FIG. 1 is a plan view illustrating a display apparatus according to an exemplary embodiment of the present invention.

FIG. 1 is a plan view illustrating a display apparatus according to an exemplary embodiment of the present invention.

Referring to FIG. 1, the display apparatus includes a printed circuit board (PCB) 100, a data driving circuit 200, and a display panel 300.

The data driving circuit 200 connected to the PCB 100 is mounted on an upper long side or a lower long side of the display panel 300 according to a scan mode of the display apparatus. For example, in a forward direction scan mode, the data driving circuit 200 connected to the PCB 100 is mounted on the upper long side of the display panel 300 in shown FIG. 1. Alternatively, in a reverse direction scan mode, data driving circuit 200 connected to the PCB 100 is mounted on the lower long side of the display panel 300.

The PCB 100 includes a timing control part 110 and a voltage generating part 120. The timing control part 110 generates timing control signals to drive the display panel 300 and provides the timing control signal to the data driving circuit 200. The timing control signals include data control signals and gate control signals. The gate control signals include a vertical start signal STVP, a first clock signal CK1, and a second clock signal CK2. The vertical start signal STVP, the first clock signal CK1, and the second clock signal CK2 have a high level substantially the same as a level of a gate-on signal and a low level substantially the same as a level of a gate-on signal. The voltage generating part 120 generates a source voltage to drive the display panel 300. For example, the voltage generating part 120 generates a gate on voltage VON, a first off signal VSS1, and a second off signal VSS2. The second off signal VSS2 has a level lower than a level of the first off signal VSS1.

The data driving circuit 200 includes a plurality of flexible printed circuit boards (FPCBs) 211, 212, and 213 and a plurality of driving chips 221, 222, and 223 respectively mounted on the FPCBs 211, 212, and 213. The FPCBs 211, 212, and 213 are electrically connected to the PCB 100 and the display panel 300. A first FPCB 211 transfers the vertical start signal STVP, the first clock signal CK1, and the second clock signal CK2 generated from the timing control part 110 to the display panel 300. The first FPCB 211 transfers the first off signal VSS1 and the second off signal VSS2 generated from the voltage generating part 120 to the display panel 300. A third FPCB 213 transfers the first off signal VSS1 generated from the voltage generating part 120 to the display panel 300.

In a forward direction scan mode, the data driving circuit 200 sequentially outputs a horizontal line data signal in a forward direction FD which advances from a first side (upper long side) of the display panel 300 to a second side (lower long side) opposite to the first side of the display panel 300. Alternatively, in a reverse direction scan mode, the data driving circuit 200 sequentially outputs the horizontal line data signal in a reverse direction RD which advances from the second side (lower long side) of the display panel 300 to the first side (upper long side) of the display panel 300.

The display panel 300 may include a display area DA and a plurality of peripheral areas including first, second, and third peripheral areas PA1, PA2, and PA3 surrounding the display area DA.

A plurality of data lines DL1, . . . , DLM and a plurality of gate linesGL1, . . . , GLn, . . . , GLN crossing the data lines DL1, . . . , DLM are disposed in the display area DA (n, N, and M are natural numbers).

In the forward direction scan mode, the data driving circuit 200 is disposed in the first peripheral area PA1, and the gate driving circuit is disposed in the second and third peripheral areas PA2 and PA3.

The gate driving circuit includes a main driving circuit 310 and an auxiliary driving circuit 320. The main driving circuit 310 generates a gate-on signal having the gate on voltage VON to output a gate line, and the auxiliary driving circuit 320 drops the gate-on signal having the gate on voltage VON applied to the gate line to the first off signal VSS1. The main driving circuit 310 is disposed in the second peripheral area PA2, and the auxiliary driving circuit 320 is disposed in the third peripheral area PA3 opposite to the second peripheral area PA2.

For example, the main driving circuit 310 includes a shift register 311 and a vertical start line 312. The shift register 311 includes a first circuit stage to an N-th circuit stage CS1, . . . , CSn, . . . , CSN respectively connected to the gate lines GL1, . . . , GLn, . . . , GLN, at least one reverse dummy stage R_DS1 and R_DS2 adjacent to the first circuit stage CS1, and at least one forward dummy stage F_DS1 and F_DS2 adjacent to the N-th circuit stage CSN.

The vertical start line 312 transfers a vertical start signal STVP to control a start timing of the main driving circuit 311. The vertical start line 312 is selectively connected to the first circuit stage CS1 or the N-th circuit stage CSN according to a scan mode of the display apparatus. For example, when the display apparatus is in the forward direction scan mode, the vertical start line 312 is electrically connected to the first circuit stage CS1 and is electrically floated with respect to the N-th circuit stage CSN. Thus, the shift register 311 sequentially provides the gate-on signals to the gate lines GL1, . . . , GLn, . . . , GLN in the forward direction FD. Alternatively, when the display apparatus is in the reverse direction scan mode, the vertical start line 312 is electrically connected the N-th circuit stage CSN and is electrically floated with respect to the first circuit stage CS1. Thus, the shift register 311 sequentially provides the gate-on signals to the gate lines GLN, . . . , GLn, . . . , GL1 in the reverse direction RD.

The auxiliary driving circuit 320 includes a falling circuit 321 and an auxiliary off line 322. The falling circuit 321 includes a first falling stage to an N-th falling stage FS1, . . . , FSn, . . . , FSN respectively connected to the gate lines GL1, . . . , GLn, . . . , GLN. The auxiliary off line 322 transfers the first off signal VSS1 and is electrically connected to the falling circuit 321. In the forward direction scan mode, the falling circuit 321 sequentially drops the gate-on signals applied to the gate lines sequentially to the first off signal VSS1 in the forward direction FD. In the reverse direction scan mode, the falling circuit 321 sequentially drops the gate-on signals applied to the gate lines sequentially to the first off signal VSS1 in the reverse direction RD.

Figure 2:
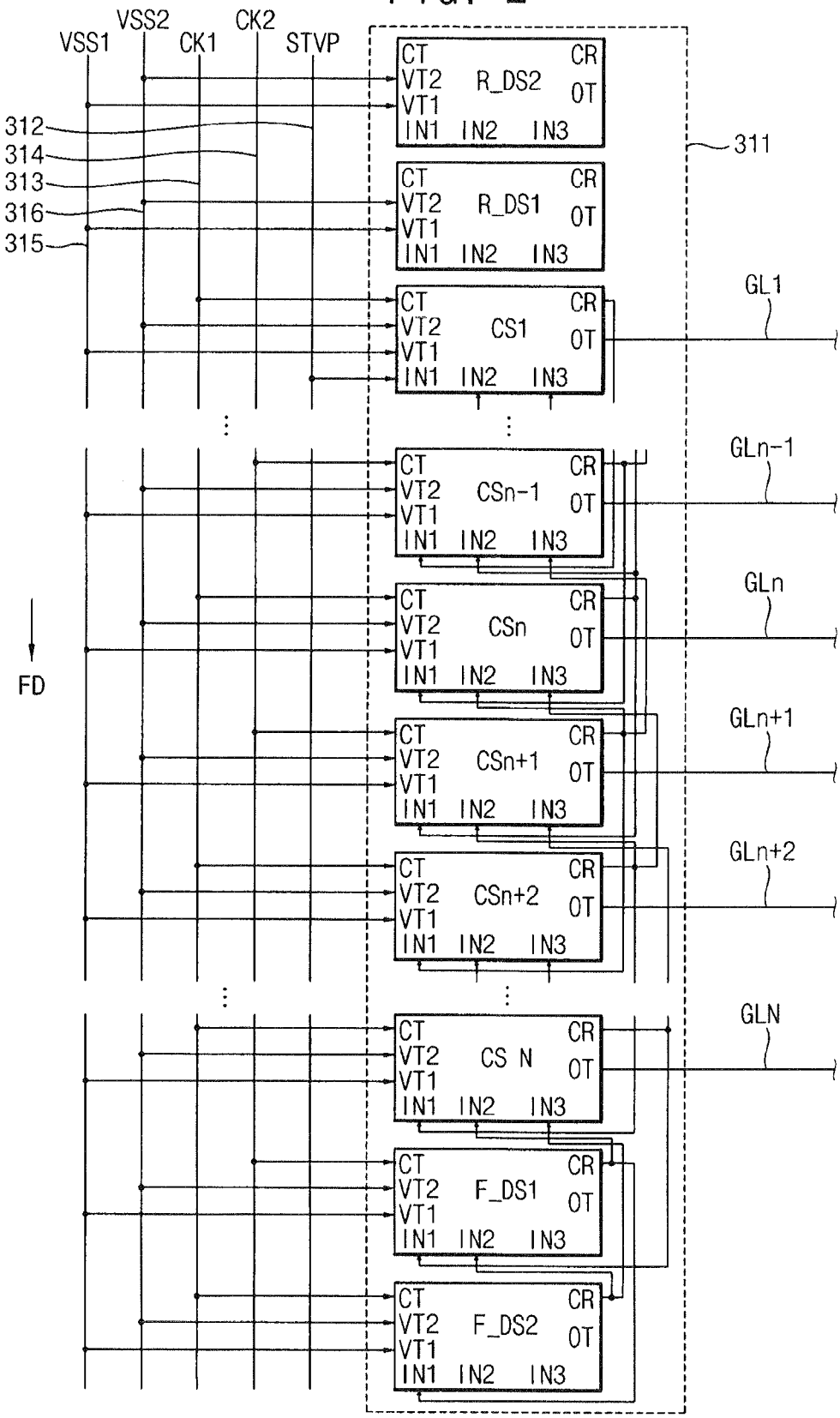
FIG. 2 is a block diagram of the main driving circuit of FIG. 1 in a forward direction scan mode.

FIG. 2 is a block diagram of the main driving circuit of FIG. 1 in a forward direction scan mode.

Referring to FIGS. 1 and 2, the main driving circuit 310 includes a shift register 311, a vertical start line 312, a first clock line 313, a second clock line 314, a first off line 315, and a second off line 316.

The shift register 311 includes first and second reverse dummy stages R_DS1 and R_DS1, first to N-th circuit stages CS1, . . . , CSn, . . . , CSN, and first and second forward dummy stages F_DS1 and F_DS2.

Each stage of the shift register 311 includes a clock terminal CT, a first off terminal VT1, a second off terminal VT2, a first input terminal IN1, a second input terminal IN2, a third input terminal IN3, an output terminal OT, and a carry terminal CR.

The clock terminal CT is connected to the first clock line 313 or the second clock line 314, and receives a first clock signal CK1 or a second clock signal CK2. The first off terminal VT1 is connected to the first off line 315 and receives the first off signal VSS1. The second off terminal VT2 is connected to the second off line 316 and receives the second off signal VSS2.

The first input terminal IN1 is connected to the vertical start line 312 or one of previous stages and receives the vertical start signal STV or a carry signal of one of the previous stages. The previous stages are driven before a present stage is driven according to the forward direction scan mode.

The second input terminal IN2 is connected to a first stage of next stages and receives the carry signal of the first stage of the next stages. The next stages are driven after the present stage is driven according to the forward direction scan mode.

The third input terminal IN3 is connected to a second stage of the next stages and receives the carry signal of the second stage of the next stages. The second stage of the next stages is driven after the first stage of the next stages, which provides the carry signal to the second input terminal IN2, is driven according to the forward direction scan mode.

The output terminal OT outputs the gate-on signal, and the carry terminal CR outputs the carry signal.

The vertical start line 312 is electrically connected to the first input terminal IN1 of the first circuit stage CS1. The vertical start line 312 is electrically floated with respect to the first input terminal IN1 of the N-th circuit stage CSN. Therefore, the shift register 311 is sequentially driven from the first circuit stage CS1 to the N-th circuit stage CSN in the forward direction FD. The first and second forward dummy stages F_DS1 and F_DS2 adjacent to the N-th circuit stage CSN are driven and control an operation of the N-th circuit stage CSN, which is a last stage of the forward direction scan mode.

The first clock signal CK1 is preset to have a duty ratio which is smaller than or equal to about 50%. The first clock line 313 is electrically connected to odd-numbered stages or even-numbered stages and transfers the first clock signal CK1 to the stages connected to the first clock line 313. According to the forward direction scan mode, the first clock line 313 is electrically floated with respect to the first and second reverse dummy stages R_DS1 and R_DS2.

The second clock signal CK2 is preset to have a duty ratio which is smaller than or equal to about 50%. The second clock line 314 is electrically connected to the odd-numbered stages or the even-numbered stages which are not connected to the first clock line 313 and transfers the second clock signal CK2 having a phase different from a phase of the first clock signal CK1 to the stages connected to the second clock line 314.

According to the forward direction scan mode, the second clock line 314 is electrically floated with respect to the first and second reverse dummy stages R_DS1 and R_DS2.

The first off line 315 is connected to each of the stages and transfers the first off signal VSS1 to the stages connected to the first off line 315. According to the forward direction scan mode, the first off line 315 is electrically floated with respect to the first and second reverse dummy stages R_DS1 and R_DS2.

The second off line 316 is connected to each of the stages and transfers the second off signal VSS2 to the stages connected to the second off line 316. According to the forward direction scan mode, the second off line 316 is electrically floated with respect to the first and second reverse dummy stages R_DS1 and R_DS2.

Hereinafter, referring to FIG. 3, a method of driving the main driving circuit in the forward direction scan mode is described.

Figure 3:
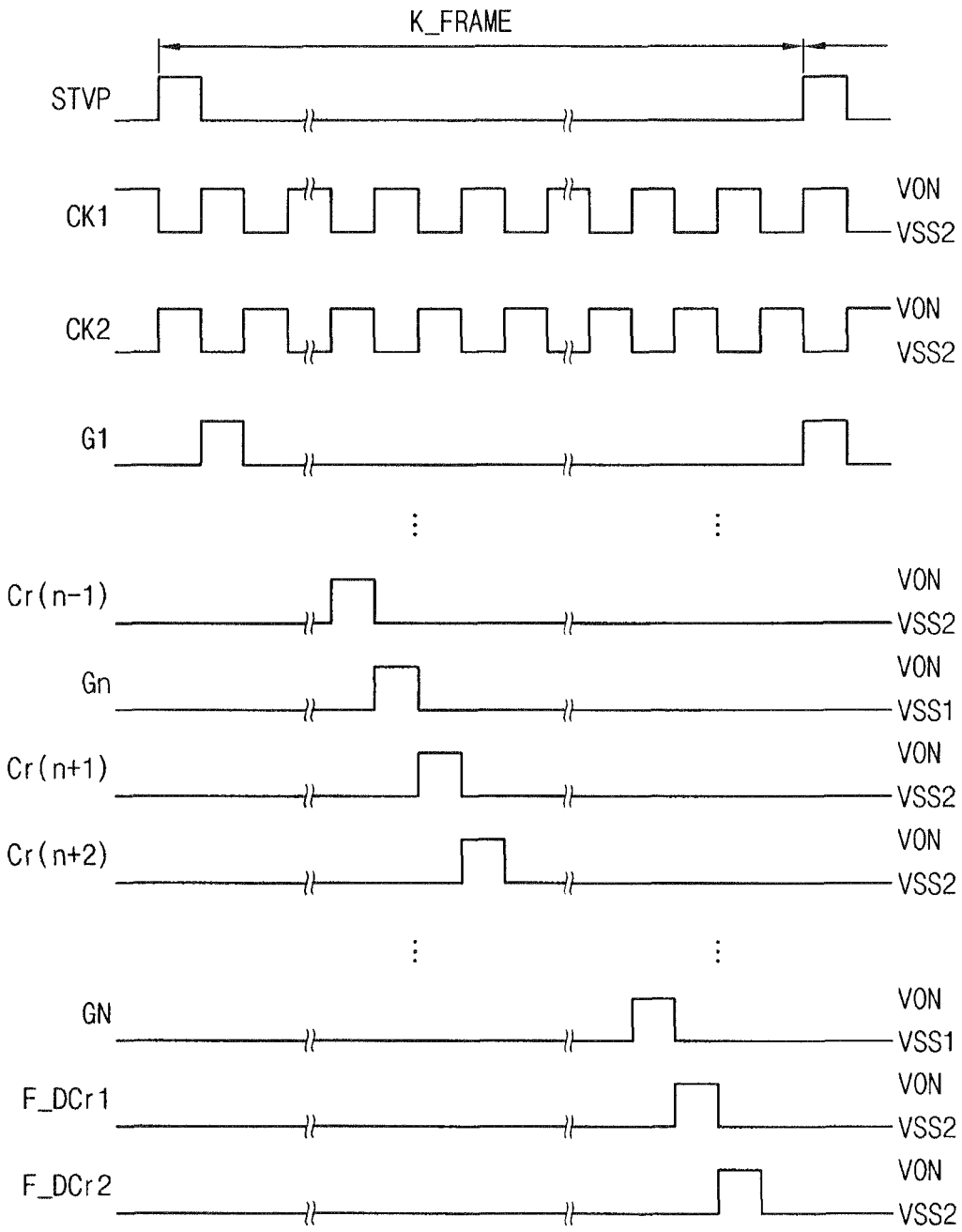
FIG. 3 is a waveform diagram showing input and output signals of the main driving circuit shown in FIG. 2.

FIG. 3 is a waveform diagram showing input and output signals of the main driving circuit shown in FIG. 2.

Referring to FIGS. 2 and 3, when the vertical start signal STVP of a K-th frame K_FRAME is applied to the vertical start line 312, the first circuit stage CS1 receives the vertical start signal STVP through the first input terminal IN1 connected to the vertical start line 312. At least one reverse dummy stage R_DS1 and R_DS2 adjacent to the first circuit stage CS1 is not substantially driven.

When the vertical start signal STVP is applied to the first circuit stage CS1, the main driving circuit is operated in the forward direction scan mode. The first circuit stage CS1 outputs a first gate-on signal G1 in response to the vertical start signal STVP.

Hereinafter, each of the stages included in the shift register 311 is described referring to the n-th circuit stage CSn.

The n-th circuit stage CSn outputs an n-th gate-on signal Gn and an n-th carry signal Cm in response to an (n−1)-th carry signal Cr(n−1) of an (n−1)-th circuit stage CSn−1 that is a previous stage of the n-th circuit stage CSn. The n-th circuit stage CSn pulls down the n-th gate-on signal Gn to the first off signal VSS1 in response to an (n+1)-th carry signal Cr(n+1) of an (n+1)-th circuit stage CSn+1 that is a next stage of the n-th circuit stage CSn. The n-th circuit stage CSn pulls down a signal applied to a control node of the n-th circuit stage CSn to the second off signal VSS2 in response to an (n+2)-th carry signal Cr(n+2) of an (n+2)-th circuit stage CSn+2 that is a next stage of the (n+1)-th circuit stage CSn+1 so that the n-th circuit stage CSn stops an operation.

An N-th circuit stage CSN that is a last stage in the shift register 311 outputs an N-th gate-on signal GN.

A first forward dummy stage F_DS1 generates a first dummy carry signal F_DCr1 corresponding to a gate-on signal in response to an N-th carry signal CrN of the N-th circuit stage CSN. The second input terminal IN2 of the N-th circuit stage CSN receives the first dummy carry signal F_DCr1 and pulls down the N-th gate-on signal GN to the first off signal VSS1 in response to the first dummy carry signal F_DCr1. A second forward dummy stage F_DS2 generates a second dummy carry signal F_DCr2 corresponding to a gate-on signal in response to the first dummy carry signal F_DCr1. The third input terminal IN3 of the N-th circuit stage CSN receives the second dummy carry signal F_DCr2, and the N-th circuit stage CSN stops an operation in response to the second dummy carry signal F_DCr2.

The second forward dummy stage F_DS2 stops an operation in response to the vertical start signal STVP of a (K+1)-th frame that is a next frame of the K-th frame K_FRAME. For example, according to an embodiment, the second input terminal IN2 or the third input terminal IN3 of the second forward dummy stage F_DS2 are connected to the vertical start line 312.

Figure 4:
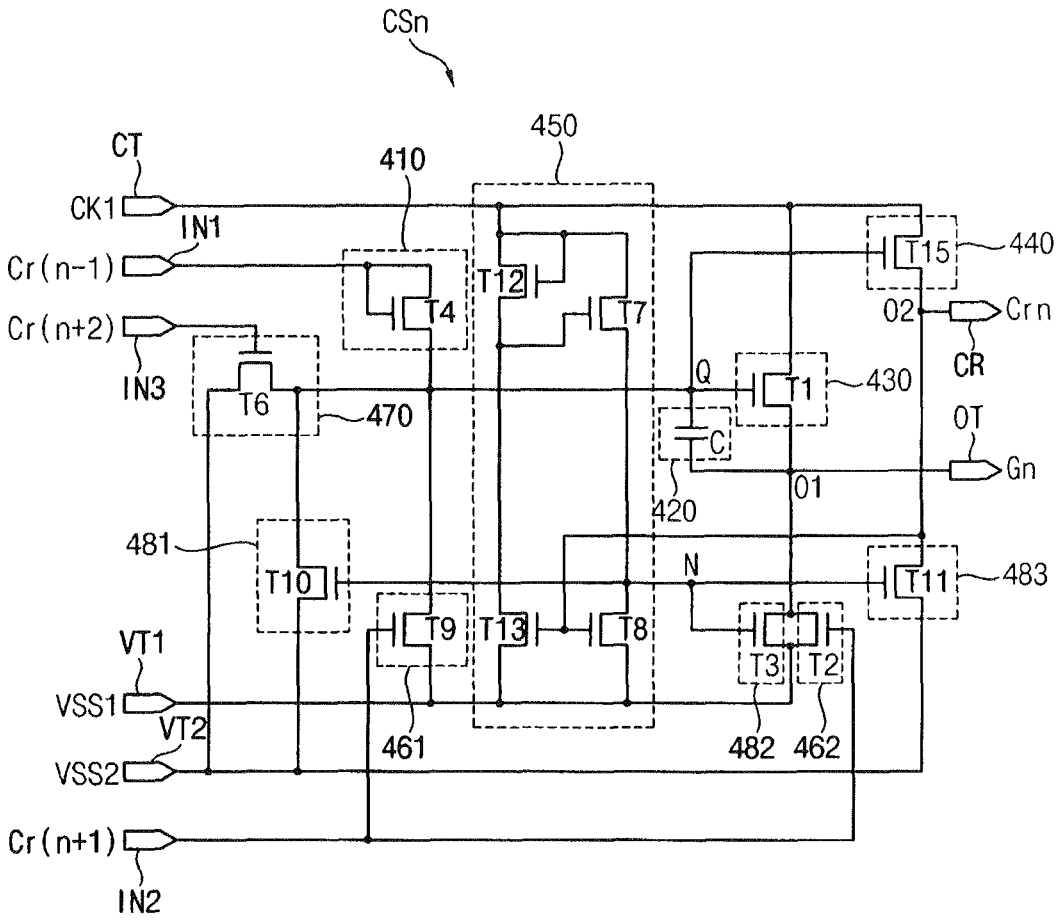
FIG. 4 is a circuit diagram of an n-th circuit stage shown in FIG. 2.

FIG. 4 is a circuit diagram of the n-th circuit stage shown in FIG. 2.

Referring to FIGS. 2 and 4, the n-th circuit stage CSn includes a pull-up control part 410, a charging part 420, a pull-up part 430, a carry part 440, an inverting part 450, a first pull-down part 461, a second pull-down part 462, a reset part 470, a first holding part 481, a second holding part 482, and a third holding part 483.

The pull-up control part 410 includes a fourth transistor T4, and the fourth transistor T4 includes a control electrode and an input electrode jointly connected to the first input terminal IN1 and an output electrode connected to a first control node Q. The first control node Q is connected to the control electrode of the pull-up part 430.

The charging part 420 includes a charging capacitor C, and the charging capacitor C includes a first electrode connected to the first control node Q and a second electrode connected to a first output node O1.

The pull-up part 430 includes a first transistor T1, and the first transistor T1 includes a control electrode connected to the first control node Q, an input electrode connected to the clock terminal CT, and an output electrode connected to the first output node O1.

The carry part 440 includes a fifteenth transistor T15, and the fifteenth transistor T15 includes a control electrode connected to the first control node Q, an input electrode connected to the clock terminal CT, and an output electrode connected to a second output node O2.

The inverting part 450 includes a twelfth transistor T12, a seventh transistor T7, a thirteenth transistor T13, and an eighth transistor T8. The twelfth transistor T12 includes a control electrode, an input electrode connected to the clock terminal CT, and an output electrode connected to the seventh transistor T7 and the thirteenth transistor T13. The seventh transistor T7 includes a control electrode connected to the output electrode of the twelfth transistor T12, an input electrode connected to the clock terminal CT, and an output electrode connected to the eighth transistor T8. The thirteenth transistor T13 includes a control electrode connected to the second output node O2, an input electrode connected to the output electrode of the twelfth transistor T12, and an output electrode connected to the first off terminal VT1. The eighth transistor T8 includes a control electrode connected to the second output node O2, an input electrode connected to the first off terminal VT1, and an output electrode connected to a second control node N.

The first pull-down part 461 includes a ninth transistor T9, and the ninth transistor T9 includes a control electrode connected to the second input terminal IN2, an input electrode connected to the first control node Q, and an output electrode connected to the first off terminal VT1.

The second pull-down part 462 includes a second transistor T2, and the second transistor T2 includes a control electrode connected to the second input terminal IN2, an input electrode connected to the first output node O1, and an output electrode connected to the first off terminal VT1.

The reset part 470 includes a sixth transistor T6, and the sixth transistor T6 includes a control electrode connected to the third input terminal IN3, an input electrode connected to the first control node Q, and an output electrode connected to the second off terminal VT2.

The first holding part 481 includes a tenth transistor T10, and the tenth transistor T10 includes a control electrode connected to the second control node N, an input electrode connected to the first control node Q, and an output electrode connected to the second off terminal VT2.

The second holding part 482 includes a third transistor T3, and the third transistor T3 includes a control electrode connected to the second control node N, an input electrode connected to the first output node O1, and an output electrode connected to the first off terminal VT1.

The third holding part 483 include an eleventh transistor T11, and the eleventh transistor T11 includes a control electrode connected to the second control node N, an input electrode connected to the second output node O2, and an output electrode connected to the second off terminal VT2.

Figure 5:
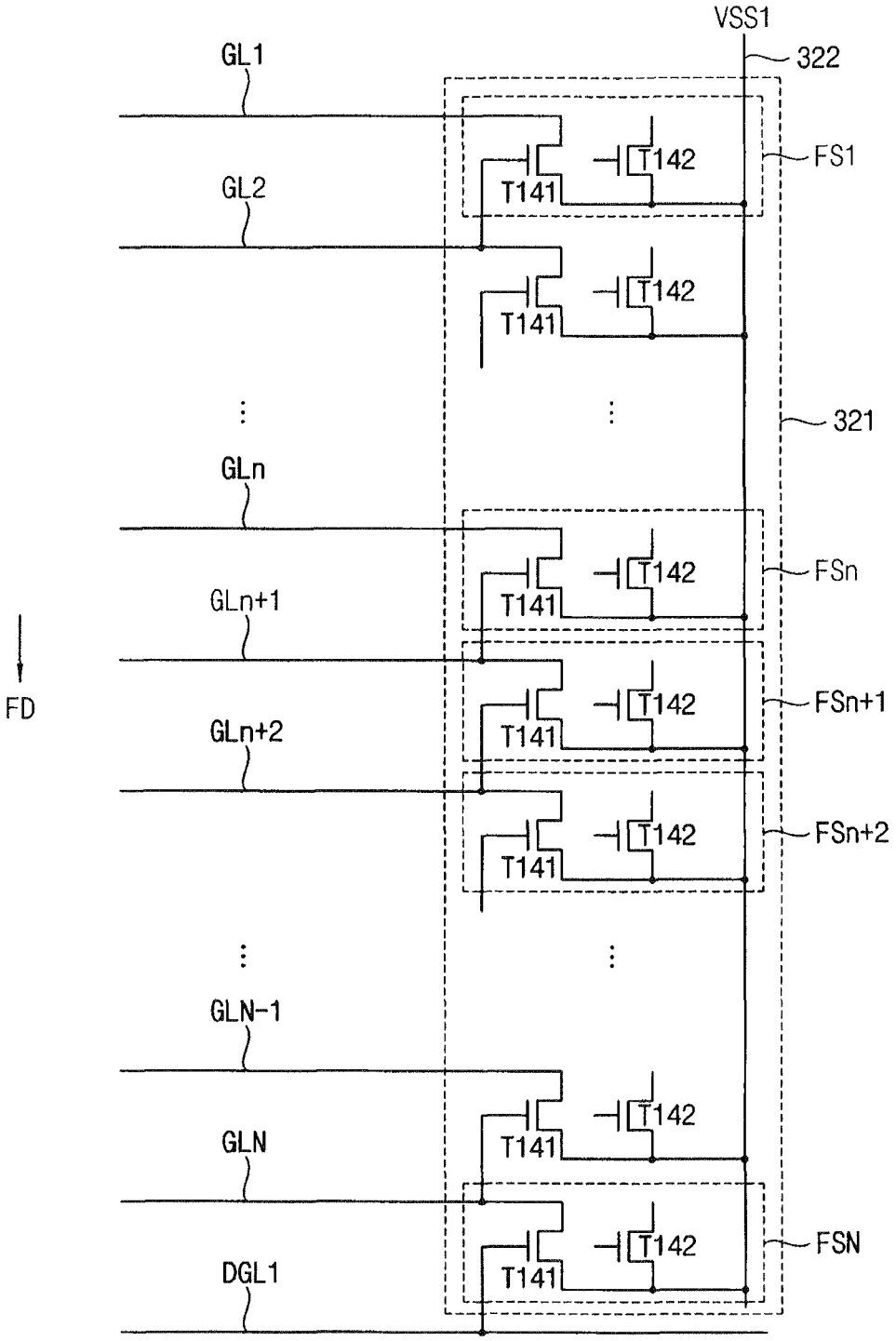
FIG. 5 is a block diagram of the auxiliary driving circuit of FIG. 1 in the forward direction scan mode.

FIG. 5 is a block diagram of the auxiliary driving circuit of FIG. 1 in the forward direction scan mode.

Referring to FIGS. 1 and 5, the auxiliary driving circuit 320 includes a falling circuit 321 and an auxiliary off line 322.

The falling circuit 321 includes a first falling stage to an N-th falling stage FS1, . . . , FSn, . . . , FSN. Each of the falling stages includes a forward direction transistor T141 electrically connected to respective corresponding gate lines and a reverse direction transistor T142 electrically floated with respect to the gate line.

The forward direction transistor T141 of the first falling stage FS1 includes a control electrode connected to a second gate line GL2, an input electrode connected to a first gate line GL1, and an output electrode connected to the auxiliary off line 322. The reverse direction transistor T142 of the first falling stage FS1 is electrically floated with respect to the first and second gate lines GL1 and GL2. Thus, the forward direction transistor T141 of the first falling stage FS1 drops a first gate-on signal applied to the first gate line GL1 to the first off signal VSS1 in response to a second gate-on signal applied to the second gate line GL2 according to the forward direction scan mode. The reverse direction transistor T142 of the first falling stage FS1 is not driven.

A second falling stage to the (N−1)-th falling stage FS2, . . . , FSN−1 sequentially drop second to (N−1)-th gate-on signals respectively applied to the second to (N−1)-th gate lines GL2, . . . , GLN−1 to the first off signal VSS1 through the forward direction transistor T141.

The forward direction transistor T141 of the N-th falling stage FSN which is a last falling stage, includes a control electrode connected to a first dummy gate line DGL1. The first dummy gate line DGL1 is connected to a dummy pixel which does not display an image. For example, a first dummy gate signal corresponding to the gate-on signal generated from the first forward dummy stage F_DS1 is applied to the first dummy gate line DGL1. Therefore, the forward direction transistor T141 of the N-th falling stage FSN drops the N-th gate-on signal applied to the N-th gate line GLN to the first off signal VSS1 in response to the first dummy gate signal.

Alternatively, the forward direction transistor T141 of the N-th falling stage FSN includes a control electrode which is electrically floated.

Figure 6:
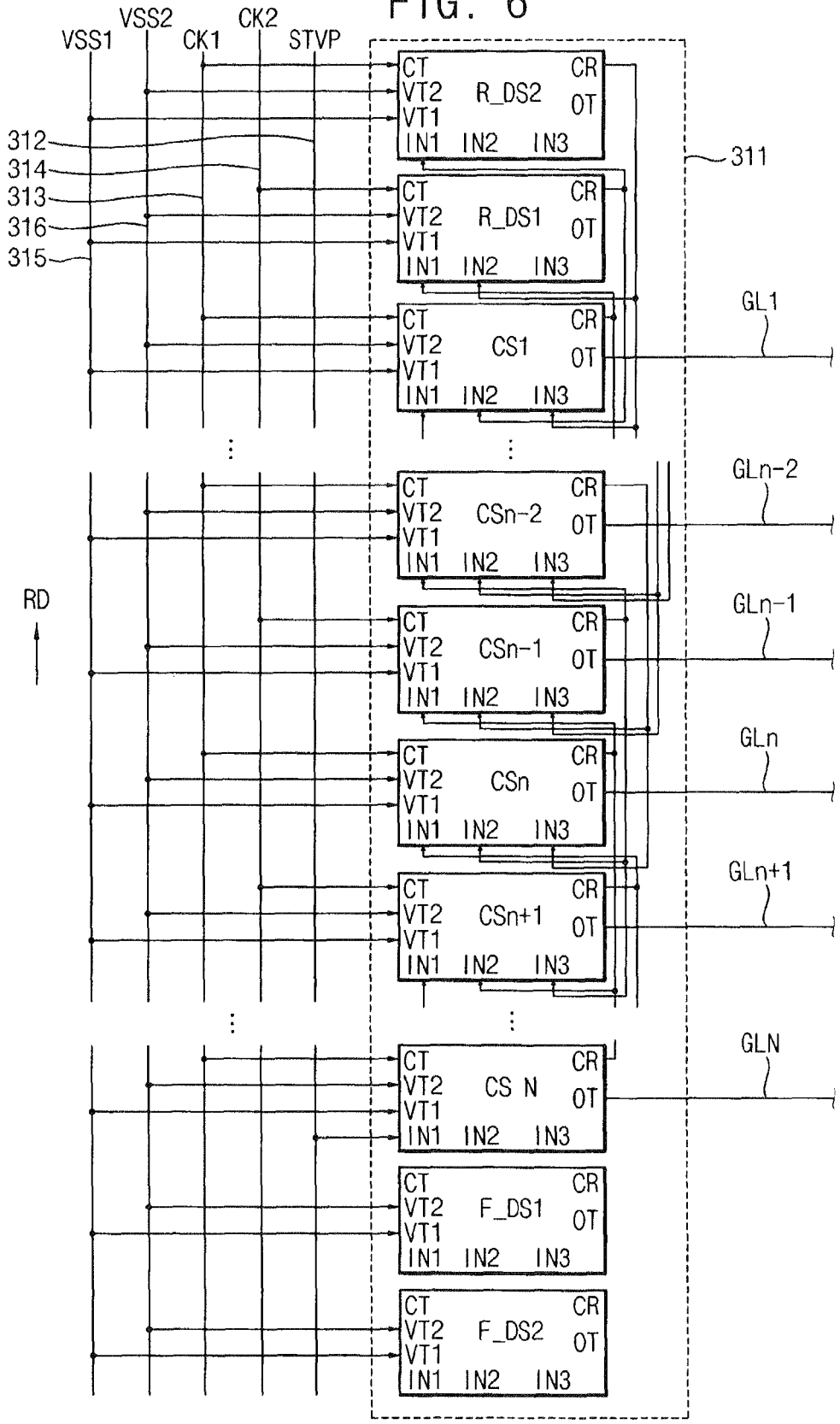
FIG. 6 is a block diagram of the main driving circuit of FIG. 1 in a reverse direction scan mode.

FIG. 6 is a block diagram of the main driving circuit of FIG. 1 in a reverse direction scan mode.

Referring to FIGS. 1 and 6, the main driving circuit 310 includes a shift register 311, a vertical start line 312, a first clock line 313, a second clock line 314, a first off line 315, and a second off line 316. Hereinafter, the same reference numerals are used to refer to the same or similar parts as in the exemplary embodiment described in connection with FIGS. 1 to 5.

Each of the stages included in the shift register 311 includes a clock terminal CT, a first off terminal VT1, a second off terminal VT2, a first input terminal IN1, a second input terminal IN2, a third input terminal IN3, an output terminal OT, and a carry terminal CR.

According to the reverse direction scan mode, the vertical start line 312 is electrically connected to the first input terminal IN1 of the N-th circuit stage CSN. However, the vertical start line 312 is electrically floated with respect to the first input terminal IN1 of the first circuit stage CS1.

Therefore, the shift register 311 is sequentially driven from the N-th circuit stage CSN to the first circuit stage CS1 in the reverse direction. The first and second reverse dummy stages R_DS1 and R_DS2 adjacent to the first circuit stage CS1 are driven to control the first circuit stage CS1 which is a last stage in the reverse direction scan mode.

The first clock line 313 is electrically connected to the odd-numbered stages or the even-numbered stages and transfers the first clock signal CK1 to the stages connected to the first clock line 313. According to the reverse direction scan mode, the first clock line 313 is electrically floated with respect to the first and second forward dummy stages F_DS1 and F_DS2.

The second clock line 314 is electrically connected to the odd-numbered stages or the even-numbered stages which are not connected to the first clock line 313 and transfers the second clock signal CK2 having a phase different from a phase of the first clock signal CK1 to the stages connected to the second clock line 314. According to the reverse direction scan mode, the second clock line 314 is electrically floated with respect to the first and second forward dummy stages F_DS1 and F_DS2.

The first off line 315 is connected to each of the stages and transfers the first off signal VSS1 to the stages connected to the first off line 315. According to the reverse direction scan mode, the first off line 315 is electrically floated with respect to the first and second forward dummy stages F_DS1 and F_DS2.

The second off line 316 is connected to each of the stages and transfers the second off signal VSS2 to the stages connected to the second off line 316. According to the reverse direction scan mode, the second off line 316 is electrically floated with respect to the first and second forward dummy stages F_DS1 and F_DS2.

Hereinafter, referring to FIG. 7, a method of driving the main driving circuit in the reverse direction scan mode is described.

Figure 7:
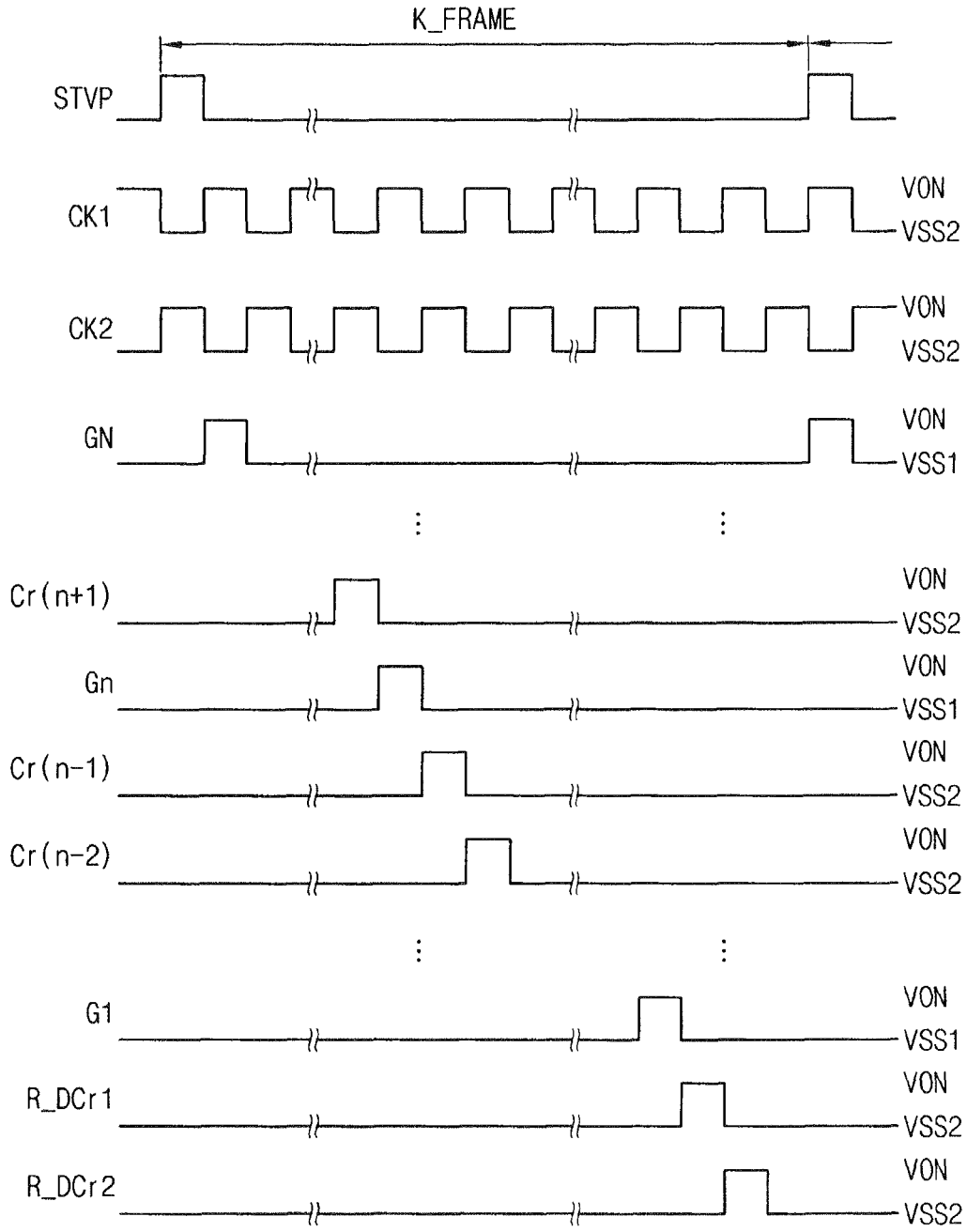
FIG. 7 is a waveform diagram showing input and output signals of the main driving circuit shown in FIG. 6.

FIG. 7 is a waveform diagram showing input and output signals of the main driving circuit shown in FIG. 6.

Referring to FIGS. 6 and 7, when the vertical start signal STVP of a K-th frame K_FRAME is applied to the vertical start line 312, the N-th circuit stage CSN receives the vertical start signal STVP through the first input terminal IN1 connected to the vertical start line 312. At least one forward dummy stage F_DS1 and F_DS2 adjacent to the N-th circuit stage CSN is not substantially driven.

When the vertical start signal STVP is applied to the N-th circuit stage CSN, the main driving circuit is operated in the forward direction scan mode. The N-th circuit stage CSN outputs the N-th gate-on signal GN in response to the vertical start signal STVP.

Hereinafter, each of the stages included in the shift register 311 is described referring to the n-th circuit stage CSn.

The n-th circuit stage CSn outputs the n-th gate-on signal Gn and the n-th carry signal Cm in response to the (n+1)-th carry signal Cr(n+1) of the (n+1)-th circuit stage CSn+1 that is the previous stage of the n-th circuit stage CSn. The n-th circuit stage CSn pulls down the n-th gate-on signal Gn to the first off signal VSS1 in response to the (n−1)-th carry signal Cr(n−1) of the (n−1)-th circuit stage CSn−1 that is the next stage of the n-th circuit stage CSn. The n-th circuit stage CSn pulls down a signal applied to a control node of the n-th circuit stage CSn to the second off signal VSS2 in response to an (n−2)-th carry signal Cr(n−2) of an (n−2)-th circuit stage CSn−2 that is a next stage of the (n−1)-th circuit stage CSn−1 so that the n-th circuit stage CSn stops an operation.

The first circuit stage CS1 that is a last stage in the shift register 311 outputs the first gate-on signal G1.

A first reverse dummy stage R_DS1 generates a first dummy carry signal R_DCr1 corresponding to a gate-on signal in response to the first carry signal Cr1 of the first circuit stage CS1. The second input terminal IN2 of the first circuit stage CS1 receives the first dummy carry signal R_DCr1 and pulls down the first gate-on signal G1 to the first off signal VSS1 in response to the first dummy carry signal R_DCr1. A second reverse dummy stage R_DS2 generates a second dummy carry signal R_DCr2 corresponding to a gate-on signal in response to the first dummy carry signal R_DCr1. The third input terminal IN3 of the first circuit stage CS1 receives the second dummy carry signal R_DCr2, and the first circuit stage CS1 stops an operation in response to the second dummy carry signal R_DCr2.

The second reverse dummy stage R_DS2 stops an operation in response to the vertical start signal STVP of a (K+1)-th frame that is a next frame of the K-th frame. For example, according to an embodiment, the second input terminal IN2 or the third input terminal IN3 of the second reverse dummy stage R_DS2 are connected to the vertical start line 312.

In the reverse direction scan mode, a circuit diagram of the n-th circuit stage CSn is the same or substantially the same as in the exemplary embodiment described in connection with FIG. 4 except for the carry signals applied to the first, second, and third input terminals IN1, IN2, and IN3.

According to the reverse direction scan mode, the first input terminal IN1 of the n-th circuit stage receives the (n+1)-th carry signal Cr(n+1) of the (n+1)-th circuit stage CSn+1 which is one of the previous stages of the n-th circuit stage. The second input terminal IN2 of the n-th circuit stage receives the (n−1)-th carry signal Cr(n−1) of the (n−1)-th circuit stage CSn−1 which is a first stage of the next stages of the n-th circuit stage. The third input terminal IN3 of the n-th circuit stage receives the (n−2)-th carry signal CR(n−2) of the (n−2)-th circuit stage CSn−2 which is a second stage of the next stages of the n-th circuit stage.

Figure 8:
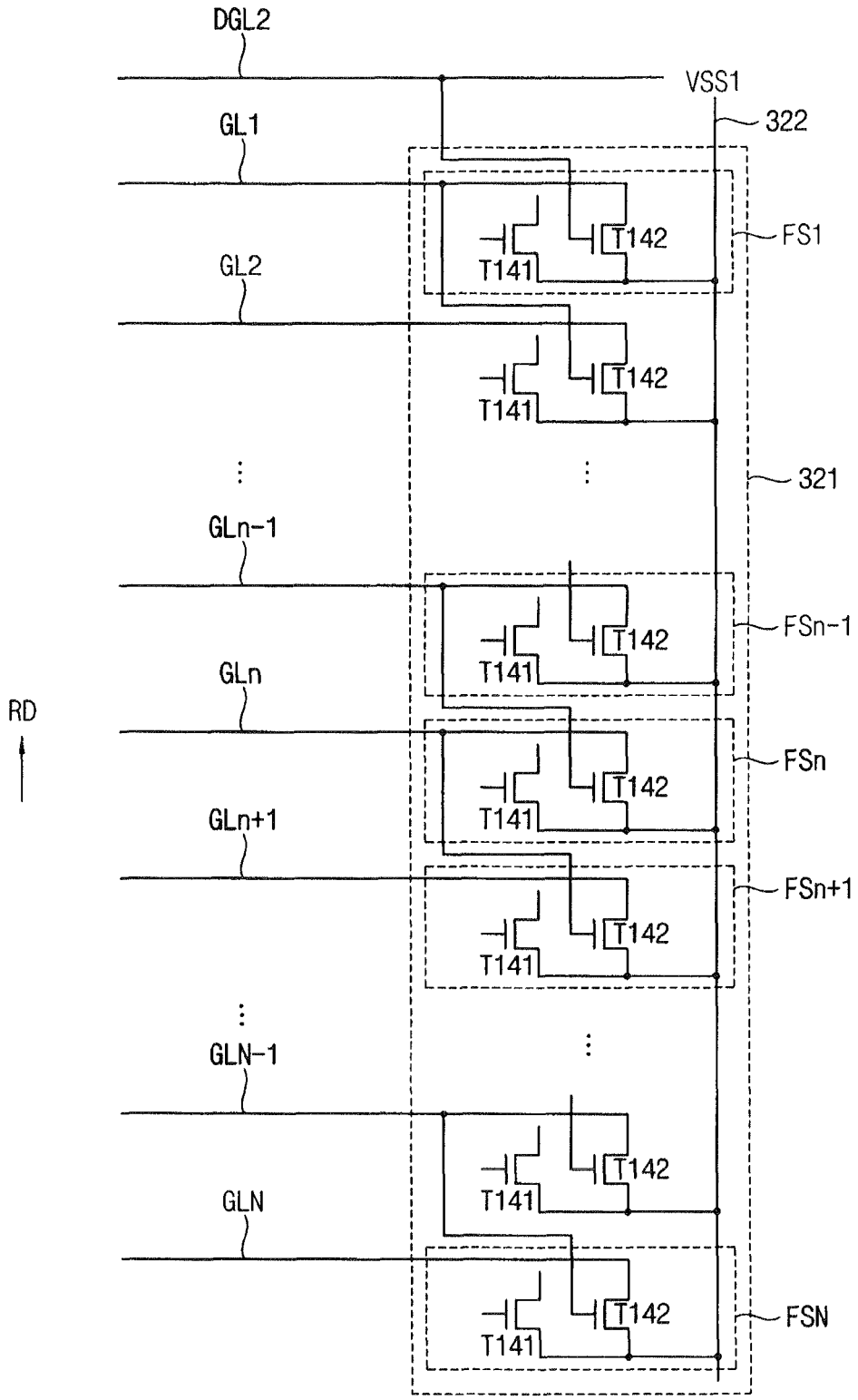
FIG. 8 is a block diagram of the auxiliary driving circuit of FIG. 1 in the reverse direction scan mode.

FIG. 8 is a block diagram of the auxiliary driving circuit of FIG. 1 in the reverse direction scan mode.

Referring to FIGS. 1 and 8, the auxiliary driving circuit 320 includes a falling circuit 321 and an auxiliary off line 322.

The falling circuit 321 includes a first falling stage to an N-th falling stages FS1, . . . , FSn, . . . , FSN. Each of the falling stages includes a reverse direction transistor T142 electrically connected to respective corresponding gate lines and a forward direction transistor T141 electrically floated with respect to the gate line.

The reverse direction transistor T142 of the N-th falling stage FSN includes a control electrode connected to an (N−1)-th gate line GLN−1 which is a next gate line of the N-th gate line GLN, an input electrode connected to the N-th gate line GLN, and an output electrode connected to the auxiliary off line 322. The forward direction transistor T141 of the N-th falling stage FSN is electrically floated with respect to the N-th and (N−1)-th gate lines GLN and GLN−1. Thus, the reverse direction transistor T142 of the N-th falling stage FSN drops a first gate-on signal applied to the N-th gate line GLN to the first off signal VSS1 in response to an (N−1)-th gate-on signal applied to the (N−1)-th gate line GLN−1 according to the reverse direction scan mode. The forward direction transistor T141 of the N-th falling stage FSN is not driven.

(N−1)-th to second falling stages FSN−1, . . . , FS2 sequentially drop (N−1)-th to second gate-on signals respectively applied to (N−1)-th to second gate lines GLN−1, . . . , GL2 to the first off signal VSS1 through the reverse direction transistor T142.

The reverse direction transistor T142 of the first falling stage FS1 which is a last falling stage in the reverse direction scan mode includes a control electrode connected to a second dummy gate line DGL2. The second dummy gate line DGL2 is connected to a dummy pixel which does not display an image. For example, according to an embodiment, a second dummy gate signal corresponding to the gate-on signal generated from the first reverse dummy stage R_DS1 is applied to the second dummy gate line DGL1. Therefore, the reverse direction transistor T142 of the first falling stage FS1 drops the first gate-on signal applied to the first gate line GL1 to the first off signal VSS1 in response to the second dummy gate signal.

Alternatively, the reverse direction transistor T142 of the first falling stage FS1 includes a control electrode which is electrically floated.

Figure 9A:
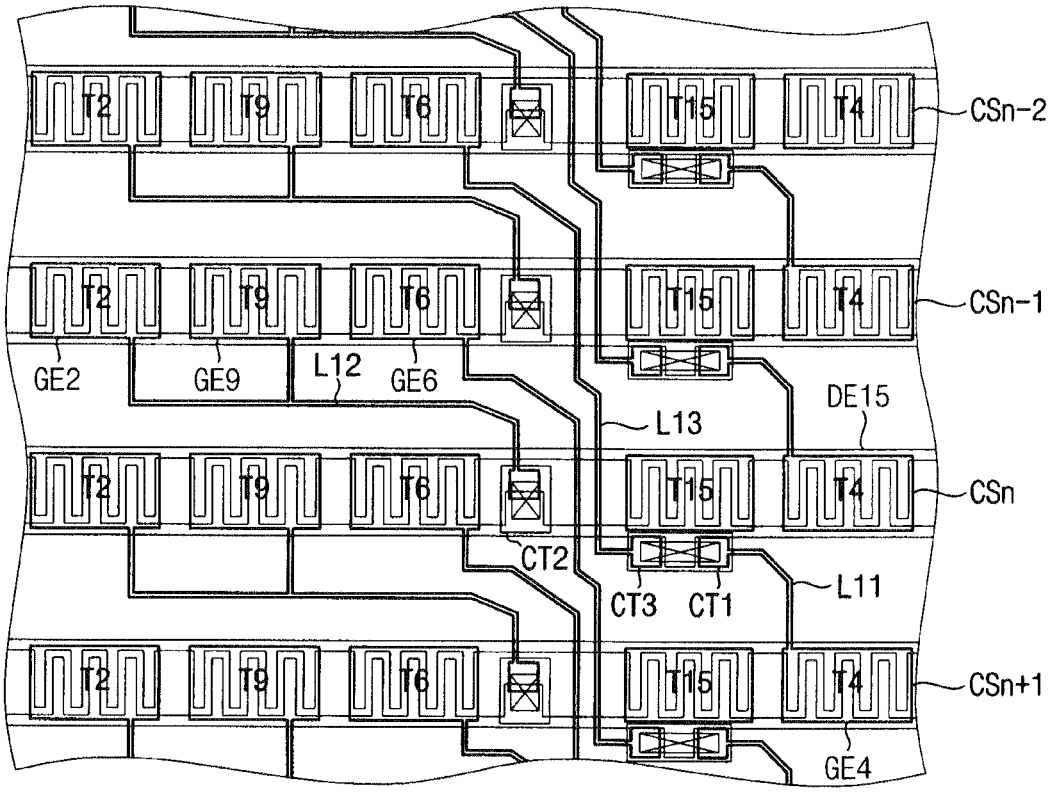
FIGS. 9A and 9B are plan views illustrating the display panel of FIG. 1 in the forward direction scan mode.
Figure 9B:
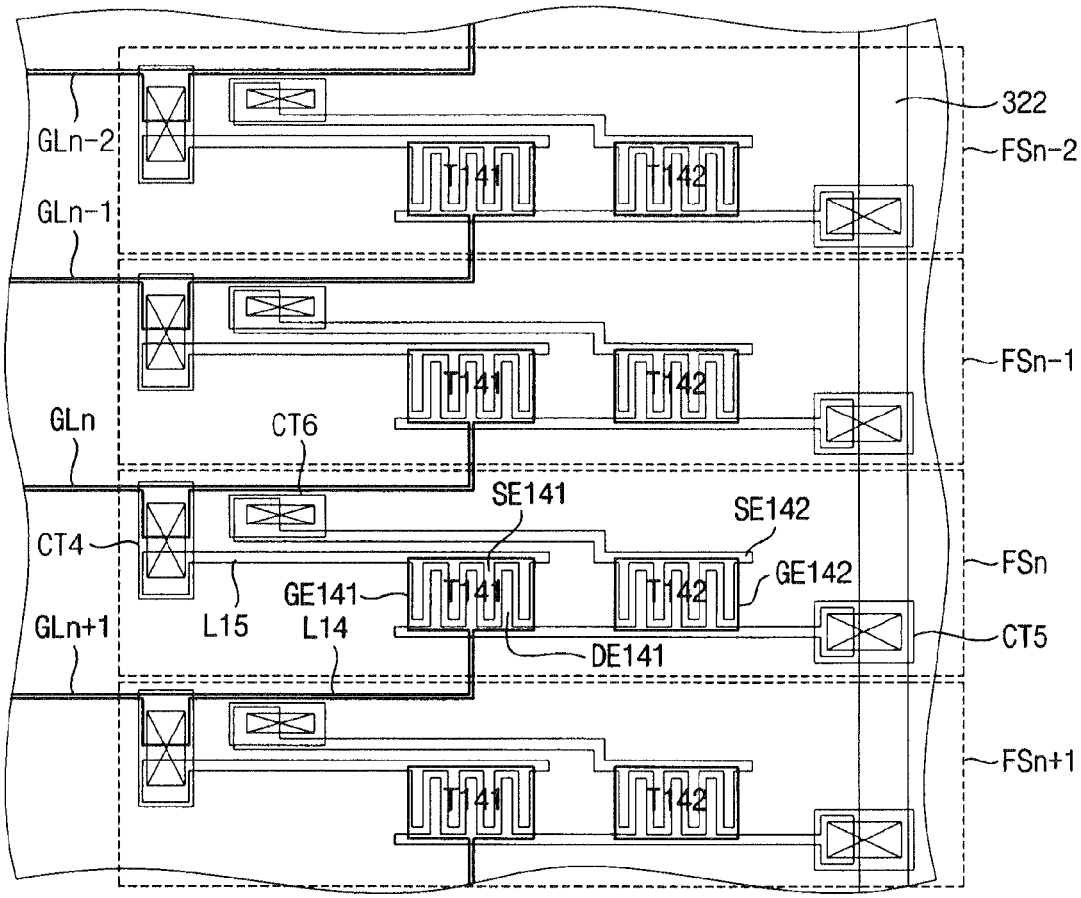

FIGS. 9A and 9B are plan views illustrating the display panel of FIG. 1 in the forward direction scan mode. FIG. 9A is a plan view illustrating the main driving circuit in the forward direction scan mode, and FIG. 9B is a plan view illustrating the auxiliary driving circuit in the forward direction scan mode.

Referring to FIGS. 2, 4, and 9A, each stage of the shift register 311 includes second, fourth, sixth, ninth, and fifteenth transistors T2, T4, T6, T9, and T15. Each of the second, fourth, sixth, ninth, and fifteenth transistors T2, T4, T6, T9, and T15 includes a control electrode that is included in a first metal pattern formed from a first metal layer, and input and output electrodes that are included in a second metal pattern formed from a second metal layer. A first insulating layer is formed on the first metal pattern, the second metal pattern is formed on the first insulating layer, and a second insulating layer is formed on the second metal pattern. The first and second metal patterns are connected to each other by a third conductive pattern. The third conductive pattern is connected to the first and second metal patterns through a contact hole formed through the first and second insulating layers. The first metal pattern includes the gate lines in the display area, the second metal pattern includes the data lines in the display area, and the third conductive pattern includes the pixel electrodes in the display area.

The fifteenth transistor T15 of each stage outputs a carry signal, the fourth transistor T4 receives a carry signal of a previous stage, the second and ninth transistors T2 and T9 receives a carry signal of a next stage, and the sixth transistor T6 receives a carry signal of a stage after the next stage.

For example, the fifteenth transistor T15 of the n-th circuit stage CSn outputting the n-th carry signal Crn is connected to the fourth transistor T4 of the (n+1)-th circuit stage CSn+1, is connected to the second and ninth transistors T2 and T9 of the (n−1)-th circuit stage CSn−1, and is connected to the sixth transistor T6 of the (n−2)-th circuit stage CSn−2.

An output electrode DE15 of the fifteenth transistor T15 is connected to a control electrode GE4 of the fourth transistor T4 through a first connection line L11, the output electrode DE15 of the fifteenth transistor T15 is connected to control electrodes GE2 and GE9 of the second and ninth transistors T2 and T9 through a second connection line L12, and the output electrode DE15 of the fifteenth transistor T15 is connected to a control electrode GE6 of the sixth transistor T6 through a third connection line L13. The first, second, and third connection lines L11, L12, and L13 are included in the first metal pattern, and the output electrode DE15 of the fifteenth transistor T15 is included in the second metal pattern.

According to the forward direction scan mode, the fourth transistor T4 of the first circuit stage CS1 is connected to the vertical start line 312, and the fourth transistor T4 of the N-th circuit stage CSN is connected to the fifteenth transistor T15 of the (n−1)-th circuit stage CSN−1 which is a previous stage of the N-th circuit stage CNS. In the first circuit stage CS1, the first connection line L11 is connected to the control electrode of the fourth transistor T4 and the vertical start line 312. For example, according to an embodiment, when the vertical start line 312 is included in the first metal pattern, the first connection line L11 is formed from a metal pattern and is connected to the vertical start line 312. Alternatively, when the vertical start line 312 is included in the second metal pattern, the first connection line L11 is connected to the vertical start line 312 through a contact part.

The output electrode DE15 of the fifteenth transistor T15 is connected to the first connection line L11 through a first contact part CT1, is connected to the second connection line L12 through a second contact part CT2, and is connected to the third connection line L13 through a third contact part CT3.

Each stage of the shift register 311 is electrically connected to adjacent stages through the first, second, and third connection lines L11, L12, and L13.

Referring to FIGS. 5 and 9B, each stage of the falling circuit 321 includes the forward direction transistor T141 and the reverse direction transistor T142. The forward and reverse direction transistors T141 and T142 each include a control electrode included in the first metal pattern and input and output electrodes included in the second metal pattern. The first insulating layer is formed on the first metal pattern, the second metal pattern is formed on the first insulating layer, and the second insulating layer is formed on the second metal pattern. The first and second metal patterns are connected to each other by a third conductive pattern. The third conductive pattern is connected to the first and second metal patterns through a contact hole formed in the first and second insulating layers. The first metal pattern includes the gate lines in the display area, the second metal pattern includes the data lines in the display area, and the third conductive pattern includes the pixel electrodes in the display area.

The forward direction transistor T141 includes a control electrode GE141 connected to a next gate line, an input electrode SE141 connected to a present gate line, and an output electrode DE141 connected to the auxiliary off line 322. The forward direction transistor T141 drops a gate-on signal applied to the present gate line to the first off signal VSS1 in response to a next gate-on signal applied to the next gate line. When the present gate line is the n-th gate line, the next gate line is the (n+1)-th gate line in the forward direction scan mode.

For example, the forward direction transistor T141 of the n-th falling stage FSn is connected to the (n+1)-th gate line GLn+1, the n-th gate line GLn, and the auxiliary off line 322. The control electrode GE141 of the forward direction transistor T141 is connected to the (n+1)-th gate line GLn+1 through the fourth connection line L14, and the input electrode SE141 of the forward direction transistor T141 is connected to the n-th gate line GLn through the fifth connection line L15. The fourth connection line L14 is included in the first metal pattern, and the fifth connection line L15 is included in the second metal pattern.

The control electrode GE141 of the forward direction transistor T141 and the fourth connection line L14 are formed from the same first metal pattern and are connected to each other. The input electrode SE141 of the forward direction transistor T141 is connected to the n-th gate line GLn of the first metal pattern through a fourth contact part CT4. The output electrode DE141 of the forward direction transistor T141 is connected to the auxiliary off line 322 of the first metal pattern through a fifth contact part CT5.

The reverse direction transistor T142 is not connected to adjacent gate lines. For example, the reverse direction transistor T142 is not substantially driven.

For example, the reverse direction transistor T142 of the n-th falling stage FSn includes a control electrode GE142 which is electrically floated. The input electrode SE142 of the reverse direction transistor T142 is not connected to adjacent gate lines, such as, for example, the (n+1)-th and the n-th gate lines GLn+1 and GLn.

A sixth contact part CT6 is formed at an end part of the input electrode SE142 included in the reverse direction transistor T142, but a metal pattern electrically connected to the n-th gate line GLn is not formed in an area in which the sixth contact part CT6 is formed. The input electrode SE142 of the reverse direction transistor T142 is not electrically connected to the n-th gate line GLn. Therefore, the sixth contact part CT6 does not perform a contact function in the forward direction scan mode. However, according to an embodiment, the sixth contact part CT6 performs the contact function in the reverse direction scan mode as the following.

Figure 10A:
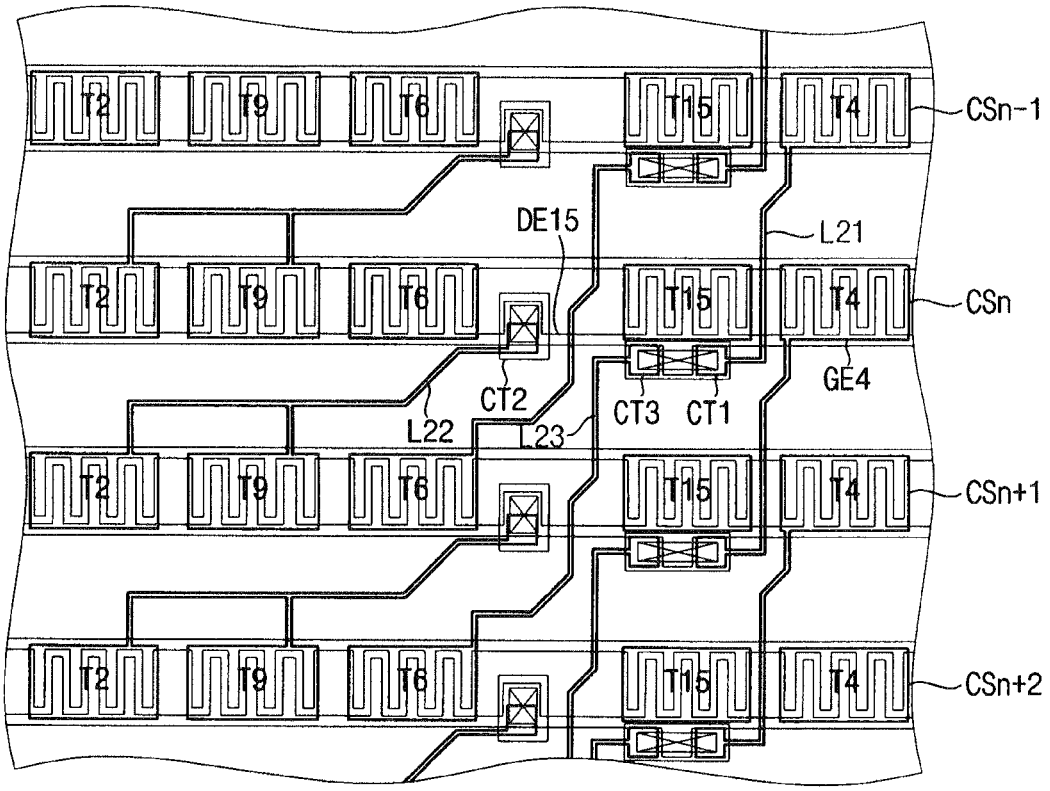
FIGS. 10A and 10B are plan views illustrating the display panel of FIG. 1 in the reverse direction scan mode.
Figure 10B:
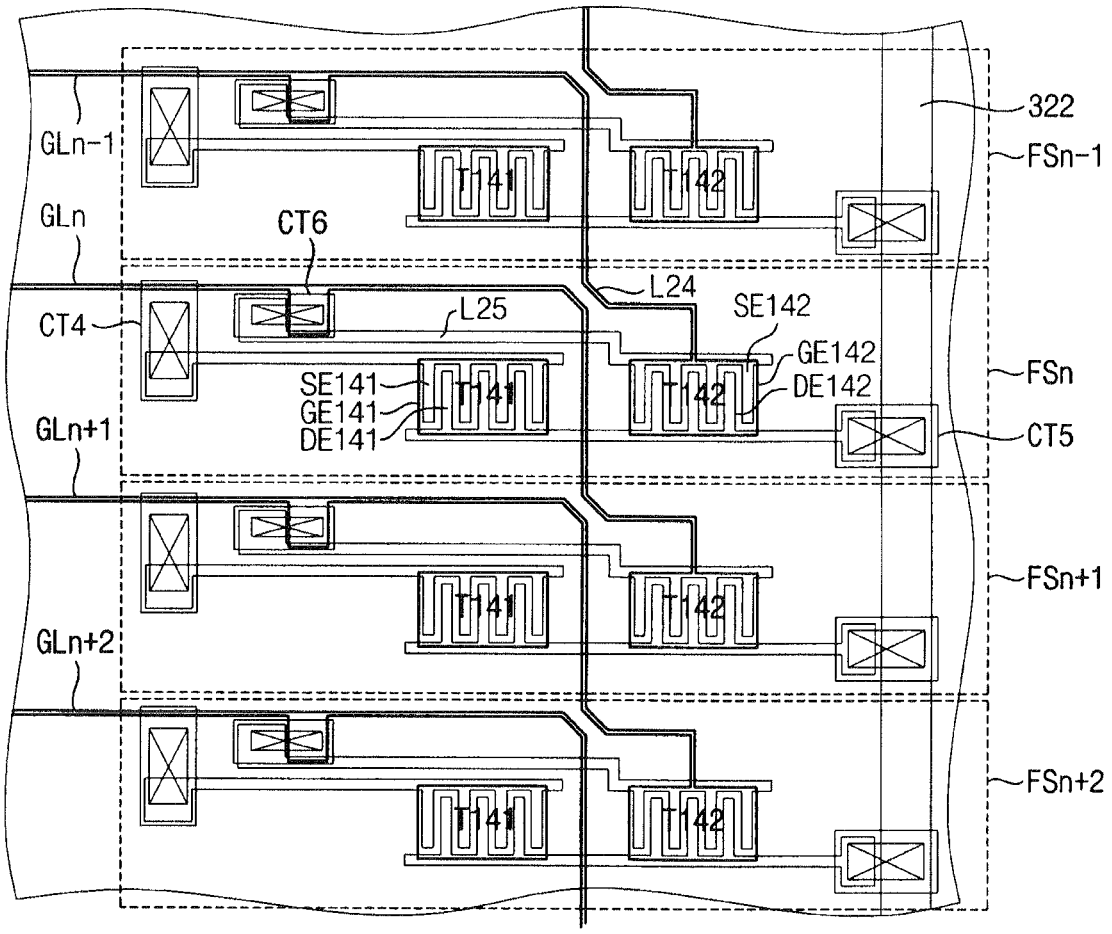

FIGS. 10A and 10B are plan views illustrating the display panel of FIG. 1 in the reverse direction scan mode. FIG. 10A is a plan view illustrating the main driving circuit in the reverse direction scan mode, and FIG. 10B is a plan view illustrating the auxiliary driving circuit in the reverse direction scan mode.

Referring to FIGS. 2 and 10A, each stage of the shift register 311 includes second, fourth, sixth, ninth, and fifteenth transistors T2, T4, T6, T9, and T15. Each of the second, fourth, sixth, ninth, and fifteenth transistors T2, T4, T6, T9, and T15 includes a control electrode of the first metal pattern, and input and output electrodes of the second metal pattern. A first insulating layer is formed on the first metal pattern, the second metal pattern is formed on the first insulating layer, and a second insulating layer is formed on the second metal pattern. The first and second metal patterns are connected to each other by a third conductive pattern. The third conductive pattern is connected to the first and second metal patterns through a contact hole formed in the first and second insulating layers. The first metal pattern includes the gate lines in the display area, the second metal pattern includes the data lines in the display area, and the third conductive pattern includes the pixel electrodes in the display area.

The fifteenth transistor T15 of each stage outputs a carry signal, the fourth transistor T4 receives the carry signal of a previous stage, the second and ninth transistors T2 and T9 receive the carry signal of a next stage, and the sixth transistor T6 receives the carry signal of a stage after the next stage.

For example, the fifteenth transistor T15 of the n-th circuit stage CSn outputting the nth carry signal Cm is connected to the fourth transistor T4 of the (n−1)-th circuit stage CSn−1, is connected to the second and ninth transistors T2 and T9 of the (n+1)-th circuit stage CSn+1, and is connected to the sixth transistor T6 of the (n+2)-th circuit stage CSn+2.

An output electrode DE15 of the fifteenth transistor T15 is connected to the control electrode GE4 of the fourth transistor T4 through a first connection line L21, the output electrode DE15 of the fifteenth transistor T15 is connected to the control electrodes GE2 and GE9 of the second and ninth transistors T2 and T9 through a second connection line L22, and the output electrode DE15 of the fifteenth transistor T15 is connected to the control electrode GE6 of the sixth transistor T6 through a third connection line L23. The first, second, and third connection lines L21, L22, and L23 are included in the first metal pattern, and the output electrode DE15 of the fifteenth transistor T15 is included in the second metal pattern.

According to the reverse direction scan mode, the fourth transistor T4 of the Nth circuit stage CSN is connected to the vertical start line 312, and the fourth transistor T4 of the first circuit stage CS1 is connected to the fifteenth transistor T15 of the second circuit stage CS2 which is a previous stage of the first circuit stage CS1. In the N-th circuit stage CSN, the first connection line L21 is connected to the control electrode of the fourth transistor T4 and the vertical start line 312. For example, according to an embodiment, when the vertical start line 312 is included in the first metal pattern, the first connection line L21 is formed from a metal pattern and is connected to the vertical start line 312. Alternatively, when the vertical start line 312 is included in the second metal pattern, the first connection line L21 is connected to the vertical start line 312 through a contact part.

The output electrode DE15 of the fifteenth transistor T15 is connected to the first connection line L21 through a first contact part CT1, is connected to the second connection line L22 through a second contact part CT2, and is connected to the third connection line L23 through a third contact part CT3.

Each stage of the shift register 311 is electrically connected to adjacent stages through the first, second, and third connection lines L21, L22, and L23.

Referring to FIGS. 8 and 10B, each stage of the falling circuit 321 includes the forward direction transistor T141 and the reverse direction transistor T142. The forward and reverse direction transistors T141 and T142 each include a control electrode of the first metal pattern, and input and output electrodes of the second metal pattern. The first insulating layer is formed on the first metal pattern, the second metal pattern is formed on the first insulating layer, and the second insulating layer is formed on the second metal pattern. The first and second metal patterns are connected to each other by a third conductive pattern. The third conductive pattern is connected to the first and second metal patterns through a contact hole formed through the first and second insulating layers. The first metal pattern includes the gate lines in the display area, the second metal pattern includes the data lines in the display area, and the third conductive pattern includes the pixel electrodes in the display area.

The reverse direction transistor T142 includes a control electrode GE142 connected to a next gate line, an input electrode SE142 connected to a present gate line, and an output electrode DE142 connected to the auxiliary off line 322. The reverse direction transistor T142 drops a gate-on signal applied to the present gate line to the first off signal VSS1 in response to a next gate-on signal applied to the next gate line. When the present gate line is the n-th gate line, the next gate line is the (n−1)-th gate line in the reverse direction scan mode.

For example, the reverse direction transistor T142 of the n-th falling stage FSn is connected to the (n−1)-th gate line GLn−1, the n-th gate line GLn, and the auxiliary off line 322. The control electrode GE142 of the reverse direction transistor T142 is connected to the (n−1)-th gate line GLn−1 through the fourth connection line L24, and the input electrode SE142 of the reverse direction transistor T142 is connected to the n-th gate line GLn through the fifth connection line L25. The fourth connection line L24 is included in the first metal pattern, and the fifth connection line L25 is included in the second metal pattern.

The control electrode GE142 of the reverse direction transistor T142 and the fourth connection line L24 are formed from the same first metal pattern and are connected to each other. The input electrode SE142 of the reverse direction transistor T142 is connected to the n-th gate line GLn of the first metal pattern through a sixth contact part CT6. The output electrode DE142 of the reverse direction transistor T142 is connected to the auxiliary off line 322 of the first metal pattern through a fifth contact part CT5.

The forward direction transistor T141 is not connected to adjacent gate lines. For example, the forward direction transistor T141 is not substantially driven.

For example, the forward direction transistor T141 of the n-th falling stage FSn includes a control electrode GE141 which is electrically floated. The input electrode SE141 of the forward direction transistor T141 is not connected to adjacent gate lines, such as, for example, which are the (n−1)-th and the n-th gate lines GLn−1 and GLn.

A fourth contact part CT4 is formed at an end part of the input electrode SE141 included in the forward direction transistor T141, but a metal pattern electrically connected to the n-th gate line GLn is not formed in an area in which the fourth contact part CT4 is formed. The input electrode SE141 of the forward direction transistor T141 is not electrically connected to the n-th gate line GLn. Therefore, the fourth contact part CT4 does not perform a contact function in the reverse direction scan mode. However, according to an embodiment, the fourth contact part CT4 performs the contact function in the forward direction scan mode as described above in connection with FIG. 9B.

Referring to FIGS. 9A, 9B, 10A, and 10B, according to an embodiment, the second metal pattern and the contact parts except for the first metal pattern including the first to the fifth connection lines L11, L12, L13, L14, L15, L21, L22, L23, L24, and L25 are formed via the same mask in the forward and reverse direction scan modes. One mask for forming the first metal pattern according to the scan mode can be changed so that display panels of the forward and reverse direction scan modes can be simply manufactured.

Hereinafter, the same reference numerals are used to refer to the same or similar elements as in the exemplary embodiment described in connection with FIGS. 1 to 10.

Figure 11:
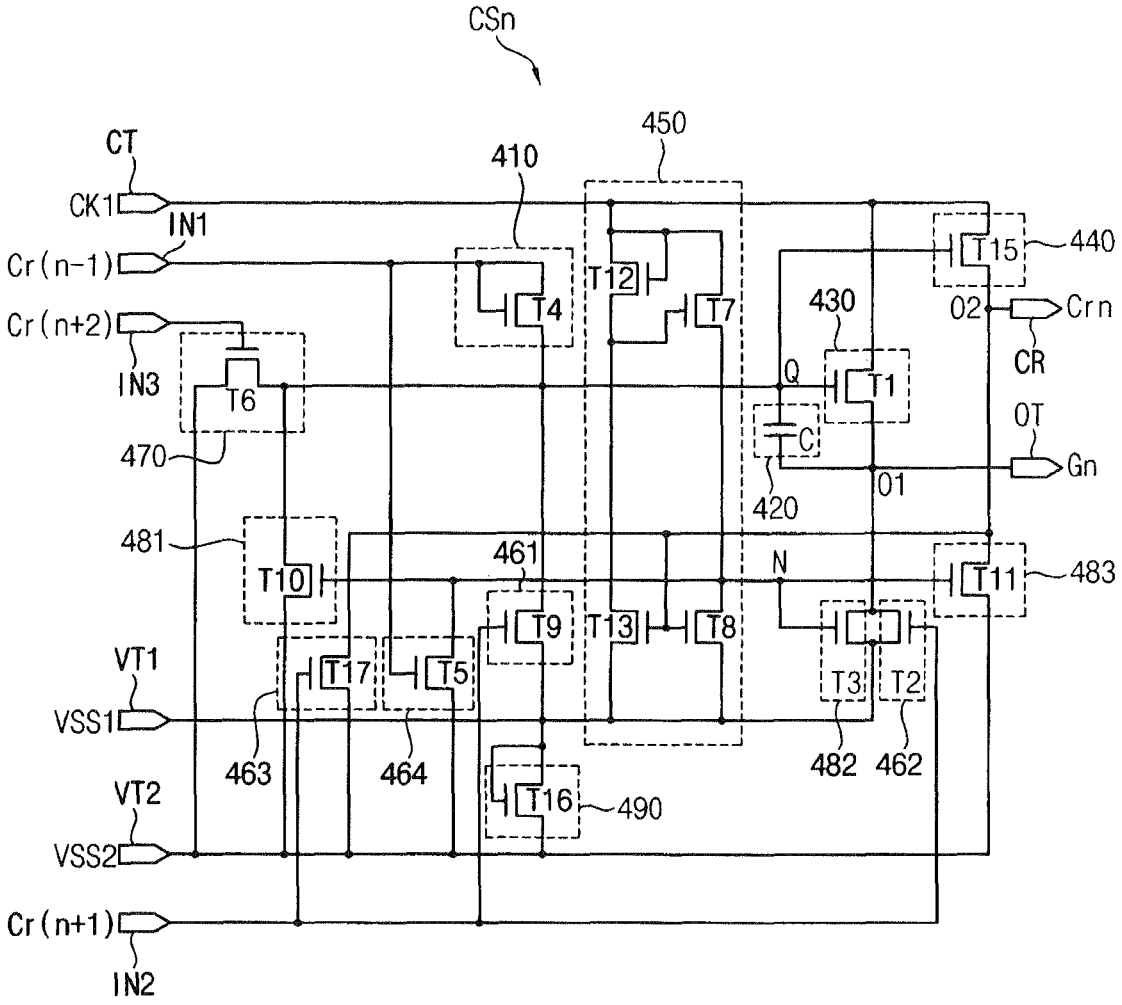
FIG. 11 is a circuit diagram of an n-th circuit stage according to an exemplary embodiment of the present invention.

FIG. 11 is a circuit diagram of an n-th circuit stage according to an exemplary embodiment of the present invention.

Referring to FIG. 11, the n-th circuit stage CSn further includes a third pull-down part 463, a fourth pull-down part 464, and a stabilizing part 490 compared with the n-th circuit stage CSn shown in FIG. 4.

The third pull-down part 463 includes a seventeenth transistor T17, and the seventeenth transistor T17 includes a control electrode connected to the second input terminal IN2, an input electrode connected to the second output node O2, and an output electrode connected to the second off terminal VT2.

The fourth pull-down part 464 includes a fifth transistor T5, and the fifth transistor T5 includes a control electrode connected to the first input terminal IN1, an input electrode connected to a second control electrode, and an output electrode connected to the second off terminal VT2.

The stabilizing part 490 includes a sixteenth transistor T16, and the sixteenth transistor T16 includes control and input electrodes connected to the output electrode of the first pull-down part 461 and an output electrode connected to the second off terminal VT2.

According to the reverse direction scan mode, the first input terminal IN1 of the n-th circuit stage CSn receives the (n+1)-th carry signal Cr(n+1) of the (n+1)-th circuit stage CSn+1 which is one of previous stages of the n-th circuit stage CSn. The second input terminal IN2 of the n-th circuit stage CSn receives the (n−1)-th carry signal Cr(n−1) of the (n−1)-th circuit stage CSn−1 which is a first stage of next stages of the n-th circuit stage CSn. The third input terminal IN3 of the n-th circuit stage CSn receives the (n−2)-th carry signal Cr(n−2) of the (n−2)-th circuit stage CSn−2 which is a second stage of the next stages of the n-th circuit stage CSn.

Figure 12:
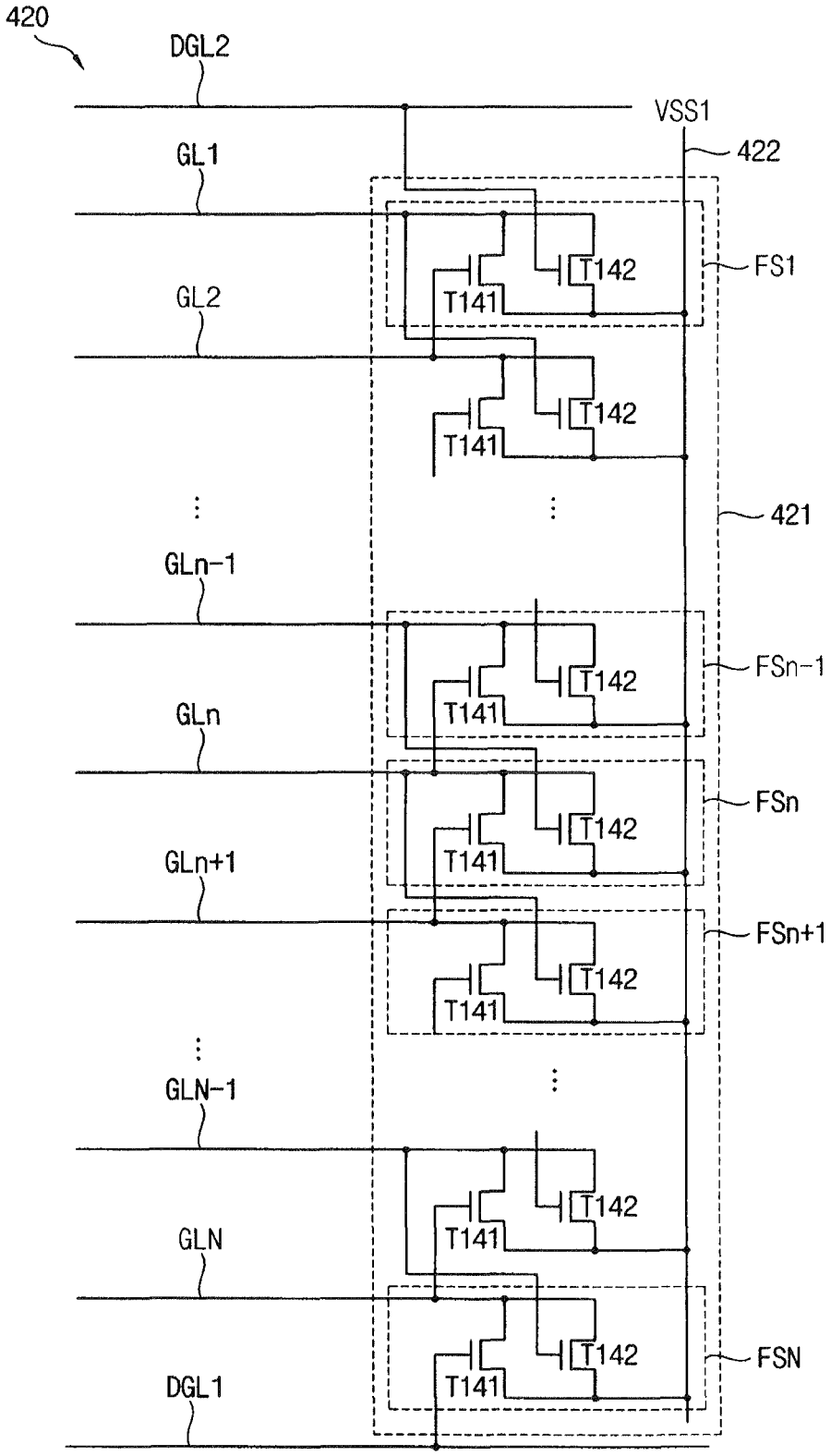
FIG. 12 is a block diagram of an auxiliary driving circuit according to an exemplary embodiment of the present invention.

FIG. 12 is a block diagram of an auxiliary driving circuit according to an exemplary embodiment of the present invention.

Referring to FIG. 12, the auxiliary driving circuit 420 includes a falling circuit 421 and an auxiliary off line 422.

The falling circuit 421 includes first to N-th falling stages FS1, . . . , FSn, . . . , FSN. Each of the falling stages includes a forward direction transistor T141 and a reverse direction transistor T142.

The forward direction transistor T141 of the n-th falling stage FSn includes a control electrode connected to the (n+1)-th gate line GLn+1 which is a next gate line according to the forward direction scan mode, an input electrode connected to the nth gate line GLn which is a present gate line, and an output electrode connected to the auxiliary off line 422.

The reverse direction transistor T142 of the n-th falling stage FSn includes a control electrode connected to the (n−1)-th gate line GLn−1 which is the next gate line according to the reverse direction scan mode, an input electrode connected to the n-th gate line GLn which is the present gate line, and an output electrode connected to the auxiliary off line 422.

In the forward direction scan mode, during an n-th period of the frame, the forward direction transistor T141 of the n-th falling stage FSn is turned on in response to the gate-on signal applied to the (n+1)-th gate line GLn+1 so that the gate-on signal applied to the n-th gate line GLn falls to the first off signal VSS1. During the n-th period of the frame, the reverse direction transistor T142 is turned off in response to the first off signal VSS1 applied to the (n−1)-th gate line GLn−1 so that the reverse direction transistor T142 does not perform the falling function which allows the gate-on signal applied to the n-th gate line GLn to fall to the first off signal VSS1.

In the reverse direction scan mode, during the n-th period of the frame, the reverse direction transistor T142 is turned on in response to the gate-on signal applied to the (n−1)-th gate line GLn−1 so that the gate-on signal applied to the n-th gate line GLn falls to the first off signal VSS1. During the n-th period of the frame, the forward direction transistor T141 is turned off in response to the first off signal VSS1 applied to the (n+1)-th gate line GLn+1 so that the forward direction transistor T141 does not perform the falling function which allows the gate-on signal applied to the n-th gate line GLn to fall to the first off signal VSS1.

According to an exemplary embodiment, the forward direction transistor T141 of the N-th falling stage FSN is connected to the first dummy gate line DGL1, and the reverse direction transistor T142 of the first falling stage FS1 is connected to the second dummy gate line DGL2.

According to an exemplary embodiment, the auxiliary driving circuit 420 has the same structure in the forward direction scan mode and the reverse direction scan mode. Therefore, in comparison with the auxiliary driving circuits of the exemplary embodiments described in connection with FIGS. 5 and 8, the auxiliary driving circuit 420 includes the same first metal pattern in the forward and reverse direction scan modes.

According to the exemplary embodiments, only the first metal pattern of the shift register is changed so that shift register may use the same or substantially the same driving signals in the forward and reverse direction scan modes. For example, the same timing control part generating the driving signals is used in the forward and reverse direction scan modes. In addition, the driving signal determining the scan mode is unnecessary so that the number of signal lines may be decreased. Therefore, an area in which the gate driving circuit is formed may be decreased so that a bezel of the display apparatus or a blocked portion of the display apparatus may be reduced.

The foregoing is illustrative of the embodiments of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims.

What is claimed is:

1. A gate driving circuit, comprising:

a shift register including first to N-th circuit stages sequentially providing first to N-th gate-on signals to first to N-th gate lines, respectively, at least one reverse dummy stage adjacent to the first circuit stage, and at least one forward dummy stage adjacent to the N-th circuit stage, wherein N is a natural number; and a vertical start line electrically connected to the first circuit stage or the N-th circuit stage according to a scan direction of the gate lines, wherein the vertical start line transfers a vertical start signal to the first or N-th circuit stage, wherein the shift register includes an n-th circuit stage, wherein n is a natural number, outputting an n-th gate-on signal, wherein the n-th circuit stage comprises:

a pull-up control part applying a carry signal of one of previous circuit stages to a control node in response to the carry signal of one of the previous circuit stages before the n-th gate-on signal is outputted according to the scan direction;

a pull-up part outputting a clock signal as the n-th gate-on signal in response to a signal applied to the control node;

a carry part outputting the clock signal as an n-th carry signal in response to the signal applied to the control node;

a first pull-down part pulling down the signal applied to the control node to a first off signal in response to a carry signal of a first next circuit stage after the n-th gate-on signal is outputted; and a second pull-down part pulling down the n-th gate-on signal to the first off signal in response to the carry signal of the first next circuit stage, wherein the n-th circuit stage further comprises:

a reset part pulling down the signal applied to the control node to a second off signal in response to a carry signal of a second next circuit stage, and wherein when the scan direction is the forward direction, the shift register further includes a first forward dummy stage including a carry part electrically connected to first and second pull-down parts of the N-th circuit stage and a second forward dummy stage electrically connected to a reset part of the N-th circuit stage, and when the scan direction is the reverse direction, the shift register further includes a first reverse dummy stage including a carry part electrically connected to first and second pull-down parts of the first circuit stage and a second reverse dummy stage electrically connected to a reset part of the first circuit stage.

2. A gate driving circuit, comprising:

a shift register including first to N-th circuit stages sequentially providing first to N-th gate-on signals to first to N-th gate lines, respectively, at least one reverse dummy stage adjacent to the first circuit stage, and at least one forward dummy stage adjacent to the N-th circuit stage, wherein N is a natural number;

a vertical start line electrically connected to the first circuit stage or the N-th circuit stage according to a scan direction of the gate lines, wherein the vertical start line transfers a vertical start signal to the first or N-th circuit stage;

a falling circuit including first to N-th falling stages which sequentially drop the first to the N-th gate-on signals applied to the first to N-th gate lines to the first off signal; and an auxiliary off line connected to the first to N-th falling stages, wherein the first off signal is transferred to the auxiliary off line, wherein each of the first to N-th falling stages comprises:

a forward direction transistor dropping a gate-on signal applied to a gate line to the first off signal when the scan direction is the forward direction; and a reverse direction transistor dropping a gate-on signal applied to a gate line to the first off signal when the scan direction is the reverse direction, wherein the falling circuit includes an n-th falling stage, wherein n is a natural number, and wherein when the scan direction is the forward direction, the forward direction transistor of the n-th falling stage includes a control electrode electrically connected to an (n+1)-th gate line, an input electrode electrically connected to an n-th gate line, and an output electrode electrically connected to the auxiliary off line, and the reverse direction transistor of the n-th falling stage includes a control electrode which is electrically floated.

3. A gate driving circuit, comprising:

a shift register including first to N-th circuit stages sequentially providing first to N-th gate-on signals to first to N-th gate lines, respectively, at least one reverse dummy stage adjacent to the first circuit stage, and at least one forward dummy stage adjacent to the N-th circuit stage, wherein N is a natural number;

a vertical start line electrically connected to the first circuit stage or the N-th circuit stage according to a scan direction of the gate lines, wherein the vertical start line transfers a vertical start signal to the first or N-th circuit stage;

a falling circuit including first to N-th falling stages which sequentially drop the first to the N-th gate-on signals applied to the first to N-th gate lines to the first off signal; and an auxiliary off line connected to the first to N-th falling stages, wherein the first off signal is transferred to the auxiliary off line, wherein each of the first to N-th falling stages comprises:

a forward direction transistor dropping a gate-on signal applied to a gate line to the first off signal when the scan direction is the forward direction; and a reverse direction transistor dropping a gate-on signal applied to a gate line to the first off signal when the scan direction is the reverse direction, wherein the falling circuit includes an n-th falling stage, wherein n is a natural number, and wherein when the scan direction is the reverse direction, the reverse direction transistor of the n-th falling stage includes a control electrode electrically connected to an (n−1)-th gate line, an input electrode electrically connected to an n-th gate line, and an output electrode electrically connected to the auxiliary off line, and the forward direction transistor of the n-th falling stage includes a control electrode which is electrically floated.

4. A display apparatus, comprising:

a display panel including a display area and a peripheral area surrounding the display area, the display panel including first to N-th gate lines sequentially arranged in a forward direction in the display area, wherein N is a natural number;

a data driving circuit sequentially providing data signals to the display panel n the forward direction;

a shift register disposed in the peripheral area, the shift register including first to N-th circuit stages respectively generating first to N-th gate-on signals, at least one reverse dummy stage adjacent to the first circuit stage, and at least one forward dummy stage adjacent to the N-th circuit stage;

a vertical start line electrically connected to the first circuit stage and electrically floated with respect to the N-th circuit stage, wherein the vertical start line transfers a vertical start signal to the first circuit stage;

a falling circuit in the peripheral area opposite to an area in which the shift register is disposed, the falling circuit including first to N-th falling stages which sequentially drop the first to N-th gate-on signals applied to the first to N-th gate lines to the first off signal, wherein each of the first to N-th falling stages includes a forward direction transistor and a reverse direction transistor; and an auxiliary off line adjacent to the falling circuit, wherein the first off signal is transferred to the auxiliary off line, wherein the falling circuit includes an n-th falling stage, wherein the forward direction transistor of the n-th falling stage includes a control electrode electrically connected to an (n+1)-th gate line, an input electrode electrically connected to the n-th gate line, and an output electrode electrically connected to the auxiliary off line, and the reverse direction transistor of the n-th falling stage includes a control electrode which is electrically floated.

5. A display apparatus, comprising:

a display panel including a display area and a peripheral area surrounding the display area, the display panel including first to Nth gate lines sequentially arranged in a forward direction in the display area, wherein N is a natural number;

a data driving circuit sequentially providing data signals to the display panel in a reverse direction opposite to the forward direction;

a shift register disposed in the peripheral area, the shift register including first to N-th circuit stages respectively generating first to N-th gate-on signals, at least one reverse dummy stage adjacent to the first circuit stage, and at least one forward dummy stage adjacent to the N-th circuit stage; and a vertical start line electrically connected to the N-th circuit stage and is electrically floated with respect to the first circuit stage, wherein the vertical start line transfers a vertical start signal to the first circuit stage, wherein the shift register includes an n-th circuit stage (n is a natural number) outputting an n-th gate-on signal, wherein the n-th circuit stage comprises:

a pull-up control part applying an (n+1)-th carry signal of an (n+1)-th circuit stage to a control node in response to the (n+1)-th carry signal;

a pull-up part outputting a clock signal as the n-th gate-on signal in response to the (n+1)-th carry signal applied to the control node;

a carry part outputting the clock signal as an n-th carry signal in response to the (n+1)-th carry signal applied to the control node;

a first pull-down part pulling down the (n+1)-th carry signal applied to the control node to a first off signal in response to an (n−1)-th carry signal of an (n−1) -th circuit stage;

a second pull-down part pulling down the n-th gate-on signal to the first off signal in response to the (n−1)-th carry signal; and a reset part pulling down the (n+1)-th carry signal applied to the control node to a second off signal in response to an (n−2)-th carry signal of an (n−2)-th circuit stage.

6. The display apparatus of claim 5, wherein the shift register comprises:

a first reverse dummy stage including a carry part electrically connected to first and second pull-down parts of the first circuit stage; and a second reverse dummy stage electrically connected to a reset part of the first circuit stage.

7. The display apparatus of claim 6, further comprising:

a clock line transferring the clock signal to the first to N-th circuit stages and the at least one reverse dummy stage, wherein the clock line is electrically floated with respect to at least one forward dummy stage.

8. A display apparatus, comprising:

a display panel including a display area and a peripheral area surrounding the display area, the display panel including first to N-th gate lines sequentially arranged in a forward direction in the display area, wherein N is a natural number;

a data driving circuit sequentially providing data signals to the display panel in a reverse direction opposite to the forward direction;

a shift register disposed in the peripheral area, the shift register including first to N-th circuit stages respectively generating first to N-th gate-on signals, at least one reverse dummy stage adjacent to the first circuit stage, and at least one forward dummy stage adjacent to the N-th circuit stage;

a vertical start line electrically connected to the N-th circuit stage and is electrically floated with respect to the first circuit stage, wherein the vertical start line transfers a vertical start signal to the first circuit stage;

a falling circuit in the peripheral area opposite to an area in which the shift register is disposed, the falling circuit including first to N-th falling stages which sequentially drop the first to N-th gate-on signals applied to the first to N-th gate lines to the first off signal, wherein each of the first to N-th falling stages includes a forward direction transistor and a reverse direction transistor; and an auxiliary off line adjacent to the falling circuit, wherein the first off signal is transferred to the auxiliary off line, wherein the falling circuit includes an n-th falling stage, wherein the reverse direction transistor of the n-th falling stage includes a control electrode electrically connected to an (n−1)-th gate line, an input electrode electrically connected to the n-th gate line, and an output electrode electrically connected to the auxiliary off line, and the forward direction transistor of the n-th falling stage includes a control electrode which is electrically floated.

* * * * *